US012351423B2

(12) United States Patent
Ito

(10) Patent No.: US 12,351,423 B2
(45) **Date of Patent: *Jul. 8, 2025**

(54) MEDIUM CONVEYING APPARATUS DETECTING BOUND MEDIUM BASED ON LIFT OF MEDIUM

(71) Applicant: PFU LIMITED, Kahoku (JP)

(72) Inventor: Takumi Ito, Kahoku (JP)

(73) Assignee: PFU LIMITED, Kahoku (JP)

( * ) Notice: Subject to any disclaimer, the term of this patent is extended or adjusted under 35 U.S.C. 154(b) by 0 days.

This patent is subject to a terminal disclaimer.

(21) Appl. No.: 18/526,885

(22) Filed: Dec. 1, 2023

(65) Prior Publication Data

US 2024/0109740 A1 Apr. 4, 2024

Related U.S. Application Data

(63) Continuation of application No. 17/650,816, filed on Feb. 11, 2022, now Pat. No. 11,866,291.

(30) Foreign Application Priority Data

Mar. 17, 2021 (JP) ..... 2021-043582

(51) Int. Cl.
*B65H 7/06* (2006.01)
*B65H 3/06* (2006.01)
(Continued)

(52) U.S. Cl.
CPC ..... *B65H 7/06* (2013.01); *B65H 3/06* (2013.01); *B65H 7/14* (2013.01); *B65H 7/18* (2013.01);
(Continued)

(58) Field of Classification Search
CPC ..... B65H 3/06; B65H 3/0684; B65H 7/00; B65H 7/02; B65H 7/04; B65H 7/06;
(Continued)

(56) References Cited

U.S. PATENT DOCUMENTS

2012/0319348 A1* 12/2012 Oshiro ..... B65H 7/125 271/153
2017/0355539 A1* 12/2017 Yoshiwara ..... H04N 1/00777
(Continued)

FOREIGN PATENT DOCUMENTS

JP 2008-169026 A 7/2008
JP 2017-222511 A 12/2017
(Continued)

*Primary Examiner* — Prasad V Gokhale
(74) *Attorney, Agent, or Firm* — WOMBLE BOND DICKINSON (US) LLP

(57) ABSTRACT

A medium conveying apparatus includes a pick roller feeding a medium, a separation roller placed on a downstream side of the pick roller in a conveying direction of a medium, an arrival detection sensor placed on a downstream side of the separation roller in the conveying direction and detecting arrival of a medium, a lift sensor detecting a lift of a medium between an upstream side of a roller nip of the pick roller and a downstream side of a roller nip of the separation roller, and a processor. The processor determines that a medium is a bound medium when a lift of a medium is detected by the lift sensor in a first predetermined period after detection of a front edge of a medium in a conveying direction by the arrival detection sensor, and executes abnormality processing when a medium is determined to be a bound medium.

16 Claims, 16 Drawing Sheets

(51) Int. Cl.
*B65H 7/14* (2006.01)
*B65H 7/18* (2006.01)

(52) U.S. Cl.
CPC .... *B65H 2553/412* (2013.01); *B65H 2553/61* (2013.01)

(58) Field of Classification Search
CPC . B65H 7/12; B65H 7/125; B65H 7/14; B65H 2511/13; B65H 2511/521; B65H 2511/522; B65H 2511/524; B65H 2513/50; B65H 2553/412; B65H 2553/61; B65H 2701/1829; B65H 2701/18292
See application file for complete search history.

(56) References Cited

U.S. PATENT DOCUMENTS

| | | | | |
|---|---|---|---|---|
| 2017/0359475 | A1* | 12/2017 | Xie | H04N 1/00628 |
| 2020/0198908 | A1* | 6/2020 | Shimosaka | B65H 3/0661 |
| 2021/0188581 | A1* | 6/2021 | Niwata | B65H 3/0661 |
| 2021/0331884 | A1* | 10/2021 | Shiota | B65H 7/18 |

FOREIGN PATENT DOCUMENTS

| | | | | |
|---|---|---|---|---|
| JP | 2018-43854 | A | 3/2018 | |
| JP | 2020-57895 | A | 4/2020 | |
| JP | 2020100454 | A * | 7/2020 | B65H 1/06 |

* cited by examiner

MEDIUM CONVEYING APPARATUS DETECTING BOUND MEDIUM BASED ON LIFT OF MEDIUM

CROSS-REFERENCE TO RELATED APPLICATIONS

This application is a continuation application of Ser. No. 17/650,816, filed Feb. 11, 2022, which claims priority to and benefit of prior Japanese Patent Application No. 2021-043582, filed on Mar. 17, 2021, the entire contents of which are incorporated herein by reference.

TECHNICAL FIELD

The present invention relates to a medium conveying technology.

BACKGROUND

In general, a medium conveying apparatus conveying and imaging a medium, such as a scanner, sequentially separates and conveys a plurality of stacked media placed on a loading tray. However, when a plurality of media are bound by a staple or the like, the media may be damaged when the media are separated. Therefore, it is required of the medium conveying apparatus to suitably detect such a bound medium and stop conveyance.

A medium conveying apparatus including a contact segment that can be pushed up by bending of a bound medium occurring when the medium is about to be separated is known (see Japanese Unexamined Patent Publication (Kokai) No. 2008-169026).

SUMMARY

According to some embodiments, a medium conveying apparatus includes a pick roller feeding a medium, a separation roller placed on a downstream side of the pick roller in a conveying direction of a medium, an arrival detection sensor placed on a downstream side of the separation roller in the conveying direction and detecting arrival of a medium, a lift sensor detecting a lift of a medium between an upstream side of a roller nip of the pick roller and a downstream side of a roller nip of the separation roller, and a processor. The processor determines that a medium is a bound medium when a lift of a medium is detected by the lift sensor in a first predetermined period after detection of a front edge of a medium in a conveying direction by the arrival detection sensor, and executes abnormality processing when a medium is determined to be a bound.

According to some embodiments, a control method for a medium conveying apparatus including a pick roller feeding a medium, a separation roller placed on a downstream side of the pick roller in a conveying direction of a medium, an arrival detection sensor placed on a downstream side of the separation roller in the conveying direction and detecting arrival of a medium, and a lift sensor detecting a lift of a medium between an upstream side of a roller nip of the pick roller and a downstream side of a roller nip of the separation roller includes determining that a medium is a bound medium when a lift of a medium is detected by the lift sensor in a first predetermined period after detection of a front edge of a medium in a conveying direction by the arrival detection sensor, and executing abnormality processing when a medium is determined to be a bound medium.

According to some embodiments, a computer-readable, non-transitory medium stores a computer program. The computer program causes a medium conveying apparatus including a pick roller feeding a medium, a separation roller placed on a downstream side of the pick roller in a conveying direction of a medium, an arrival detection sensor placed on a downstream side of the separation roller in the conveying direction and detecting arrival of a medium, and a lift sensor detecting a lift of a medium between an upstream side of a roller nip of the pick roller and a downstream side of a roller nip of the separation roller to execute a process. The process includes determining that a medium is a bound medium when a lift of a medium is detected by the lift sensor in a first predetermined period after detection of a front edge of a medium in a conveying direction by the arrival detection sensor, and executing abnormality processing when a medium is determined to be a bound medium.

DESCRIPTION OF EMBODIMENTS

It is to be understood that both the foregoing general description and the following detailed description are exemplary and explanatory, and are not restrictive of the invention, as claimed.

Hereinafter, a medium conveying apparatus, a control method, and a computer-readable, non-transitory medium storing a computer program according to an embodiment, will be described with reference to the drawings. However, it should be noted that the technical scope of the invention is not limited to these embodiments, and extends to the inventions described in the claims and their equivalents.

Figure 1:
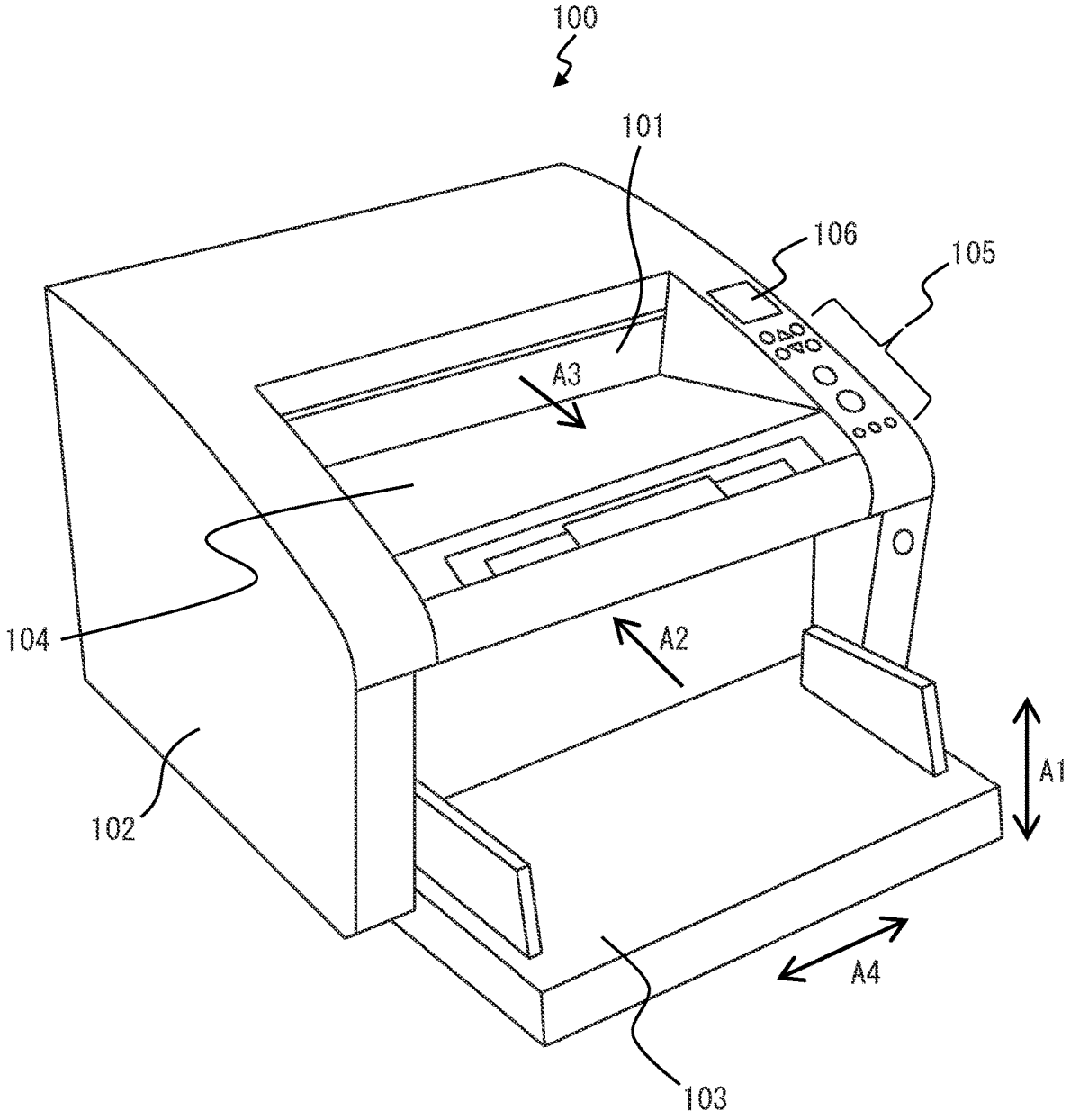
FIG. 1 is a perspective view of a medium conveying apparatus 100.

FIG. 1 is a perspective view illustrating a medium conveying apparatus 100 configured as an image scanner. The medium conveying apparatus 100 conveys and images a medium being an original. A medium is paper, thick paper, or the like. Further, media include a bound medium acquired by binding a plurality of media by a binder such as a staple, a string, or a clip, and a card medium smaller and thicker than paper, such as a driver's license or an IC card. The medium conveying apparatus 100 may be a facsimile, a copying machine, a multifunctional peripheral (MFP), or the like. The medium conveying apparatus 100 may be a printer, and in this case, a conveyed medium is an object being printed on.

The medium conveying apparatus 100 includes a first housing 101, a second housing 102, a loading tray 103, an output tray 104, an operation device 105, and a display device 106.

The first housing 101 is arranged on the upper side of the medium conveying apparatus 100. The first housing 101 is engaged with the second housing 102 by a hinge in such a way as to be openable in a case of a medium being stuck, cleaning inside the medium conveying apparatus 100 being performed, or the like.

The loading tray 103 is engaged with the second housing 102 in such a way as to be able to place a conveyed medium. The loading tray 103 is provided on the lateral surface of a medium feed side of the second housing 102 to be movable by an unillustrated motor in an almost vertical direction (height direction) A1. The loading tray 103 is arranged at a lower end position in such a way that a medium can be easily placed when a medium is not conveyed, and is raised to a position where a medium placed on the uppermost side is in contact with a pick roller to be described later when a medium is conveyed. The output tray 104 is formed on the first housing 101 in such a way as to be able to hold ejected media and loads the ejected media.

The operation device 105 includes an input device such as a button and an interface circuit acquiring a signal from the input device, receives input operation by a user, and outputs an operation signal based on the input operation by the user. The display device 106 includes a display such as a liquid crystal display or organic electro-luminescence (EL) display, and an interface circuit outputting image data to the display the display device 106 displays the image data on the display.

In FIG. 1, an arrow A2 indicates a medium conveying direction, an arrow A3 indicates a medium ejecting direction, and an arrow A4 indicates a width direction orthogonal to the medium conveying direction. An upper stream hereinafter refers to an upper stream in the medium conveying direction A2 or the medium ejecting direction A3, and a lower stream refers to a lower stream in the medium conveying direction A2 or the medium ejecting direction A3.

Figure 2:
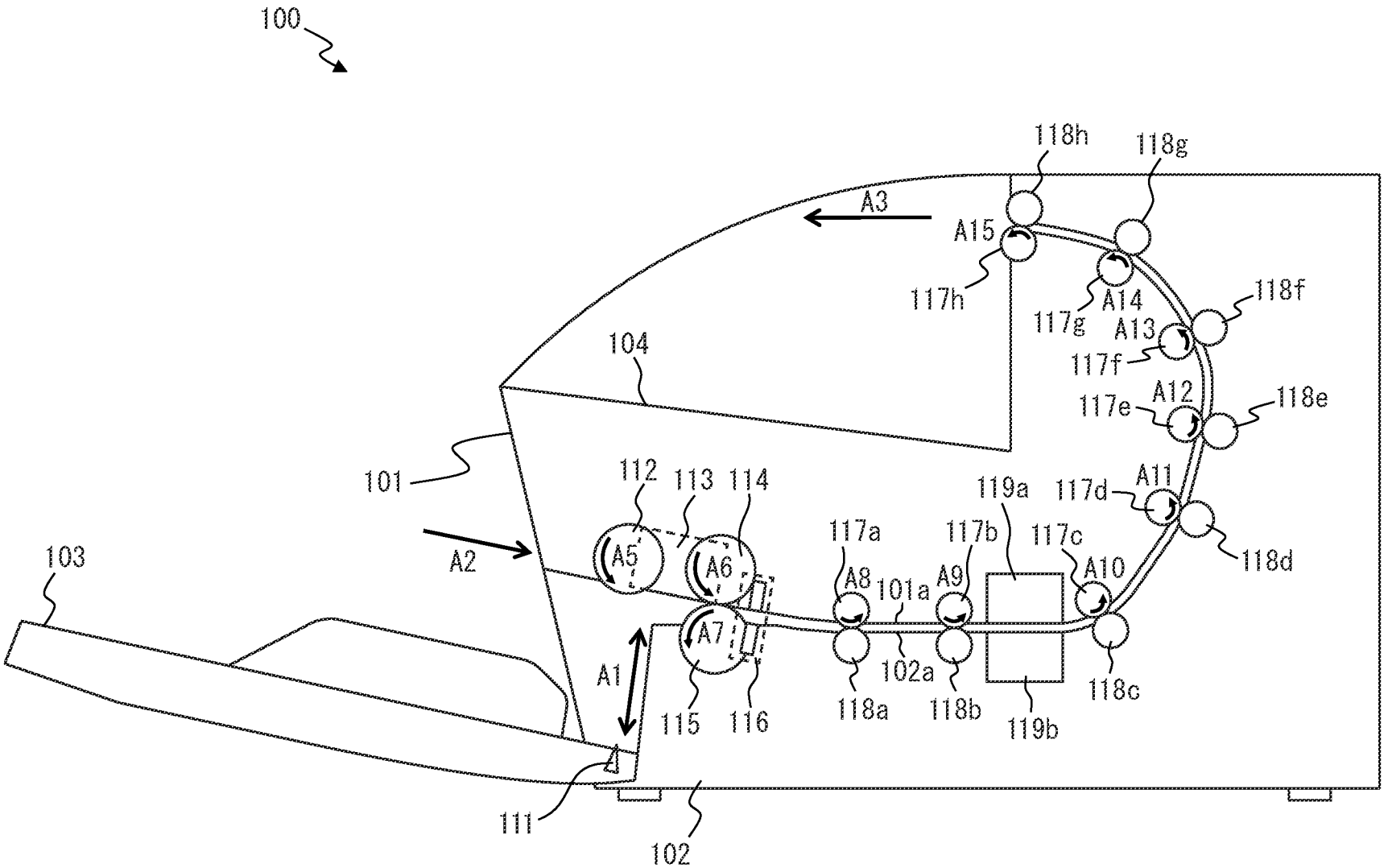
FIG. 2 is a schematic diagram for illustrating a conveyance path in the medium conveying apparatus 100.

FIG. 2 is a view for illustrating a conveyance path inside the medium conveying apparatus 100. The conveyance path inside the medium conveying apparatus 100 includes a first medium sensor 111, a pick roller 112, a lift sensor 113, a feed roller 114, a brake roller 115, a second medium sensor 116, first to eighth conveyance rollers 117*a* to 117*h*, first to eighth driven rollers 118*a* to 118*h*, a first imaging device 119*a*, and a second imaging device 119*b*. The first imaging device 119*a* and the second imaging device 119*b* may be hereinafter collectively referred to as an imaging device 119.

The number of each of the pick roller 112, the feed roller 114, the brake roller 115, and the first to eighth conveyance rollers 117*a* to 117*h* and/or the first to eighth driven rollers 118*a* to 118*h* is not limited to one and may be more than one. In that case, the plurality of pick rollers 112, feed rollers 114, brake rollers 115, first to eighth conveyance rollers 117*a* to 117*h* and/or first to eighth driven rollers 118*a* to 118*h* are respectively spaced in the width direction A4.

A surface of the first housing 101 facing the second housing 102 forms a first guide 101*a* of a conveyance path of a medium, and a surface of the second housing 102 facing the first housing 101 forms a second guide 102*a* of the conveyance path of a medium.

The first medium sensor 111 is placed on the loading tray 103, in other words, on the upstream side of the feed roller 114 and the brake roller 115 and detects a placement state of a medium on the loading tray 103. The first medium sensor 111 determines whether or not a medium is placed on the loading tray 103 by a contact detection sensor passing a predetermined current when a medium is in contact with the sensor or when a medium is not in contact with the sensor. The first medium sensor 111 generates and outputs a first medium signal, the signal value of which varies between a state in which a medium is placed on the loading tray 103 and a state in which a medium is not placed. The first medium sensor 111 is not limited to a contact detection sensor, and any other sensor capable of detecting existence of a medium, such as a light detection sensor, may be used as the first medium sensor 111.

The pick roller 112 is provided on the first housing 101. The pick roller 112 comes in contact with a medium placed on the loading tray 103 raised to a height almost identical to that of the medium conveyance path, and feeds the medium toward the downstream side.

The lift sensor 113 is provided inside the first housing 101 on the downstream side of the pick roller 112. The lift sensor 113 detects a lift of a medium fed by the pick roller 112. A lift of a medium refers to a curve of a fed medium toward the first housing 101 side with respect to the conveyance path. A structure of the lift sensor 113 will be described later by use of FIG. 3.

The feed roller 114 is placed inside the first housing 101 on the downstream side of the lift sensor 113. The feed roller 114 feeds a medium fed by the pick roller 112 further toward the downstream side. The brake roller 115 is placed inside the second housing 102 and faces the feed roller 114. The feed roller 114 and the brake roller 115 constitutes an example of a separation roller and perform a separation operation of a medium for separating media and feeding one medium at a time. The feed roller 114 is placed above the brake roller 115, and the medium conveying apparatus 100 feeds a medium by a so-called top-first scheme.

The second medium sensor 116 is placed on the downstream side of the feed roller 114 and the brake roller 115. The second medium sensor 116 is an example of an arrival detection sensor and detects whether or not a medium exists at the position of the second medium sensor 116. The second medium sensor 116 is a recurrent prism sensor and includes a light-emitting element, a photodetector, and a light-guiding member.

The light-emitting element and the photodetector are placed outside the medium conveyance path with the second guide 102*a* in between. The light-guiding member is a light-guiding tube such as a U-shaped prism and is placed outside the medium conveyance path in such a way that both ends face the light-emitting element and the photodetector, respectively, with the first guide 101*a* in between. The light-emitting element is a light-emitting diode (LED) or the like and projects light toward the light-guiding member with the medium conveyance path in between. The photodetector receives light projected from the light-emitting element and guided by the light-guiding member. The photodetector generates and outputs a second medium signal being an electric signal based on intensity of the received light. When a medium exists at the position of the second medium sensor 116, light projected from the light-emitting element is shaded by the medium; and therefore the signal value of the second medium signal varies between a state in which a medium exists at the position of the second medium sensor 116 and a state in which a medium does not exist. Consequently, the second medium sensor 116 detects arrival of a medium.

The configuration of the second medium sensor 116 is not limited to the aforementioned example. For example, a reflection member such as a mirror may be used in place of the light-guiding member. Further, the second medium sensor 116 may be configured only with the light-emitting element and the photodetector. In this case, the light-emitting element and the photodetector are placed on the first housing 101 and the second housing 102, respectively, in such a way as to face each other with the medium conveyance path in between. Further, the second medium sensor 116 may be a contact detection sensor similar to the first medium sensor 111.

The first to eighth conveyance rollers 117*a* to 117*h* and the first to eighth driven rollers 118*a* to 118*h* are provided on the downstream side of the feed roller 114 and the brake roller 115 and convey a medium fed by the feed roller 114 and the brake roller 115 toward the downstream side. The first to eighth conveyance rollers 117*a* to 117*h* and the first to eighth driven rollers 118*a* to 118*h* are placed in such a way as to face one another with the medium conveyance path in between, respectively.

The first imaging device 119*a* is provided on the downstream side of the first and second conveyance rollers 117*a* and 117*b* and the first and second driven rollers 118*a* and 118*b* in the medium conveying direction A2. The first imaging device 119*a* includes a line sensor based on a unit magnification optical system type contact image sensor (CIS) including complementary metal oxide semiconductor-(CMOS-) based imaging elements linearly arranged in a main scanning direction. The first imaging device 119*a* includes lenses each forming an image on an imaging element and an A/D converter amplifying and analog-digital (A/D) converting an electric signal output from the imaging element. The first imaging device 119*a* generates and outputs an input image, which is an image captured of the front surface of the conveyed medium.

The second imaging device 119*b* is provided on the downstream side of the first and second conveyance rollers 117*a* and 117*b* and the first and second driven rollers 118*a* and 118*b* in the medium conveying direction A2. The second imaging device 119*b* includes a line sensor based on a unity-magnification optical system type contact image sensor (CIS) including complementary metal oxide semiconductor-(CMOS-) based imaging elements linearly arranged in the main scanning direction. The second imaging device 119*b* includes lenses each forming an image on an imaging element and an A/D converter amplifying and analog-digital (A/D) converting an electric signal output from the imaging element. The second imaging device 119*b* generates and outputs an input image, which is an image captured of the back surface of the conveyed medium.

The medium conveying apparatus 100 may include only one of the first imaging device 119*a* and the second imaging device 119*b* and read only one side of a medium. Further, a line sensor based on a unity-magnification optical system type CIS including charge coupled device-(CCD-) based imaging elements may be used in place of the line sensor based on a unity-magnification optical system type CIS including CMOS-based imaging elements. Further, a reduction optical system type line sensor including CMOS- or CCD-based imaging elements may be used.

A medium placed on the loading tray 103 is conveyed between the first guide 101*a* and the second guide 102*a* in the medium conveying direction A2 by the pick roller 112 and the feed roller 114 rotating in medium feeding directions A5 and A6, respectively. On the other hand, when a plurality of media are placed on the loading tray 103, only a medium in contact with the feed roller 114 out of the media placed on the loading tray 103 is separated by the brake roller 115 rotating in a direction A7 opposite to the medium feeding direction.

A medium is fed to an imaging position of the imaging device 119 by the first and second conveyance rollers 117*a* and 117*b* rotating in directions of arrows A8 and A9, respectively, while being guided by the first guide 101*a* and the second guide 102*a* and is imaged by the imaging device 119. Furthermore, the medium is ejected onto the output tray 104 by the third to eighth conveyance rollers 117*c* to 117*h* rotating in directions of arrows A10 to A15, respectively. The output tray 104 loads media ejected by the eighth conveyance roller 117*h*.

Figure 3:
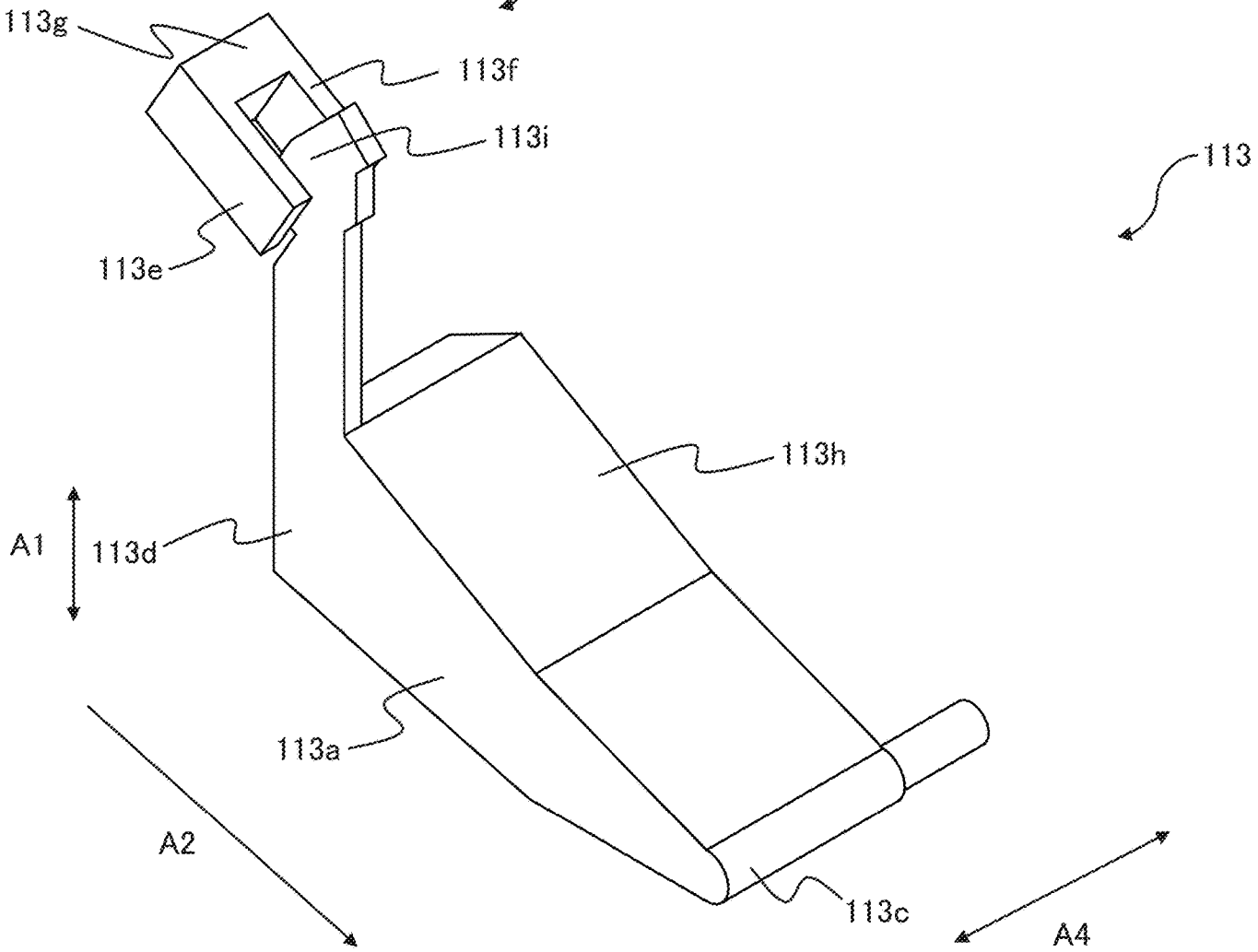
FIG. 3 is a perspective view for illustrating a configuration of a lift sensor 113.

FIG. 3 is a perspective view for illustrating the structure of the lift sensor 113.

The lift sensor 113 includes an arm 113*a* and a horseshoe-shaped sensor 113*b*. The arm 113*a* includes an arm body 113*h* and an arm tip 113*i* closer to the lift sensor than the arm body, as shown in FIG. 3.

The arm 113*a* is provided above the conveyance path of a medium in such a way that the longitudinal direction of the arm 113*a* is in parallel to the medium conveying direction A2. The bottom surface of the arm 113*a* is placed in such a way as to face the second guide 102*a* with separated by a predetermined distance. When a plurality of lift sensors 113 are provided, the arms 113*a* are placed at an identical height in the height direction A1. A downstream-side edge 113*c* of the arm 113*a* is mounted to be rotatable on the first housing 101 in such a way that an upstream-side edge 113*d* swings. The predetermined distance is set to a distance acquired by adding a margin to a maximum height to which a medium can be bent during medium feed. Consequently, when a fed medium does not lift, the medium is conveyed without coming in contact with the arm 113*a*. Further, when a fed medium lifts, the medium comes in contact with the arm 113*a* and raises the arm 113*a* by rotating the arm 113*a*. In other words, the arm 113*a* is placed in such a way as to be raised according to a lift of a medium.

The horseshoe-shaped sensor 113*b* includes a light-emitting element 113*e*, a photodetector 113*f*, and a connecting part 113*g* connecting the light-emitting element 113*e* to the photodetector 113*f*. The light-emitting element 113*e* and the photodetector 113*f* are placed in such a way as to face each other. The light-emitting element 113*e* is an LED or the like and projects light toward the photodetector 113*f*. The photodetector 113*f* is a photodiode or the like. The light-emitting element 113*e* and the photodetector 113*f* are examples of a light-emitting part and a light-receiving part, respectively.

The photodetector 113*f* is provided to face the light-emitting element 113*e* with the arm 113*a* in between and detects light from the light-emitting element 113*e*. The photodetector 113*f* generates and outputs a lift detection signal being an electric signal based on intensity of the detected light.

The arm 113*a* is provided in such a way as to be placed between the light-emitting element 113*e* and the photodetector 113*f* in an unraised state and be placed at a position not facing the light-emitting element 113*e* and the photodetector 113*f* in a raised state. In other words, the arm 113*a* is formed in such a way as to interrupt light from the light-emitting element 113*e* to the photodetector 113*f* in an unraised state and pass light from the light-emitting element 113*e* to the photodetector 113*f* in a raised state. Consequently, the signal value of the lift detection signal varies between a case in which a fed medium lifts and a case in which a fed medium does not lift. In other words, the lift sensor 113 detects a lift of a medium by detecting a rise of the arm 113*a* when the photodetector 113*f* detects light from the light-emitting element 113*e*.

Figure 4:
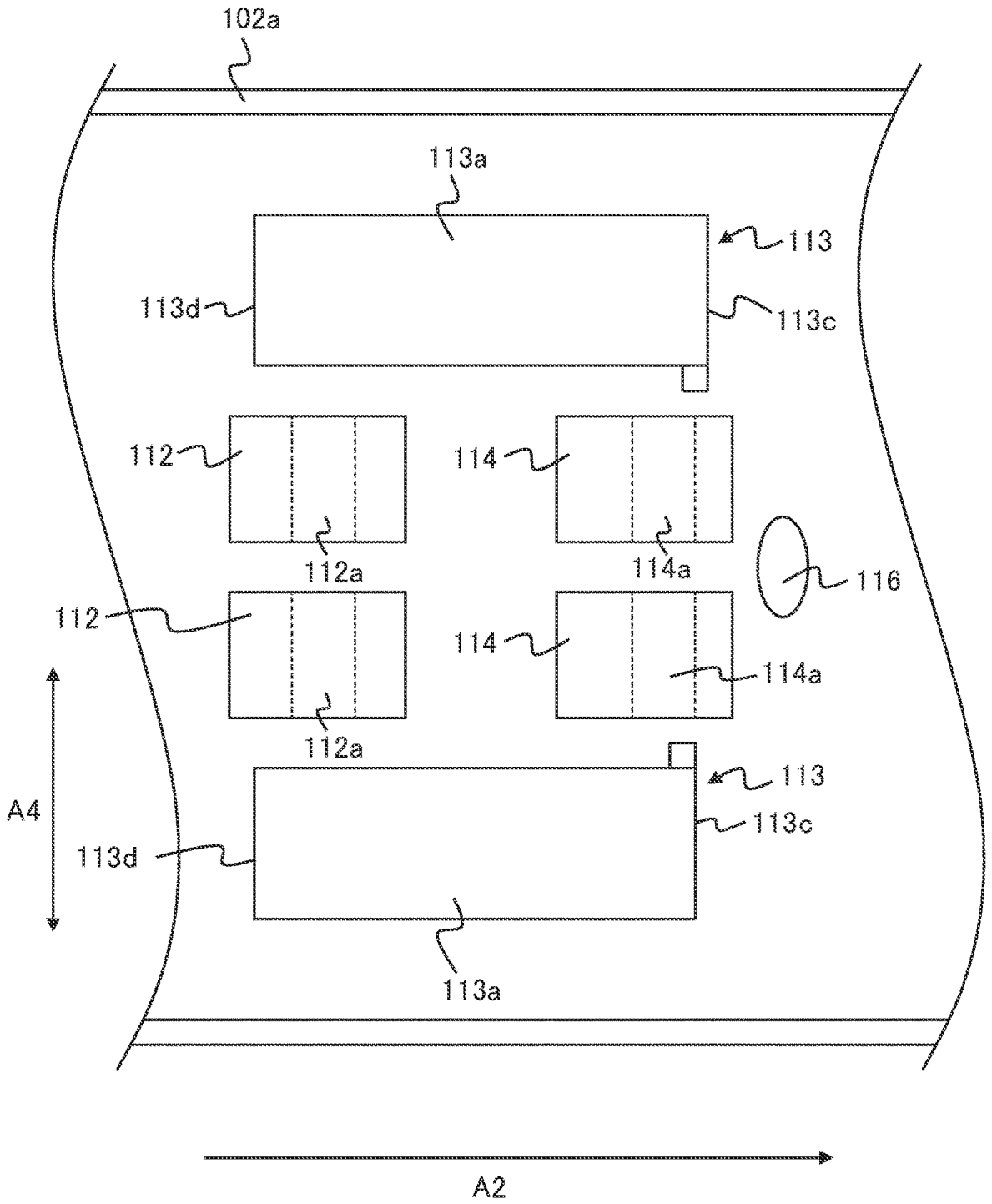
FIG. 4 is a schematic diagram for illustrating placement of the lift sensors 113 and a second medium sensor 116.

FIG. 4 is a diagram for illustrating placement of the lift sensors 113 and the second medium sensor 116. FIG. 4 is a schematic diagram illustrating a positional relation between the lift sensors 113 and the second medium sensor 116 when the conveyance path is viewed from above.

In the example illustrated in FIG. 4, each of two lift sensors 113 is arranged outside the pick rollers 112 and the feed rollers 114 in the width direction A4. Structures of the two lift sensors 113 are identical except that the structures are symmetric with respect to the width direction A4. The number of the lift sensors 113 is not limited to two and may be one, or three or greater.

The lift sensors 113 are placed in such a way as to be separated from the pick roller 112 and the feed roller 114 by a predetermined distance in the width direction A4. The predetermined distance is set in such a way that when a medium with the shortest length in the width direction A4 out of media generally highly likely to be bound by a staple, a clip, or the like (for example, A5 size) is conveyed, an edge of the medium in the width direction A4 passes below the arm 113*a*. Consequently, the lift sensor 113 can detect a lift of any medium conveyable by the medium conveying apparatus 100 when the medium is conveyed.

The upstream-side edge 113*d* of the arm 113*a* in the lift sensor 113 is positioned on the upstream side of the upstream edge of a roller nip 112*a* of the pick roller 112. The downstream-side edge 113*c* of the arm 113*a* in the lift sensor 113 is positioned on the downstream side of the downstream edge of roller nips 114*a* of the feed roller 114 and the brake roller 115. Consequently, the lift sensor 113 detects a lift of a medium occurring between the upstream side of the roller nip 112*a* of the pick roller 112 and the downstream side of the roller nips 114*a* of the feed roller 114 and the brake roller 115.

The second medium sensor 116 is placed on the downstream side of the brake roller 115. The second medium sensor 116 is placed between the two brake rollers 115 and particularly almost at the center in the width direction A4. While only one second medium sensor 116 is placed in the example illustrated in FIG. 4, a plurality of second medium sensors 116 may be placed with spaced along the width direction A4.

Figure 5:
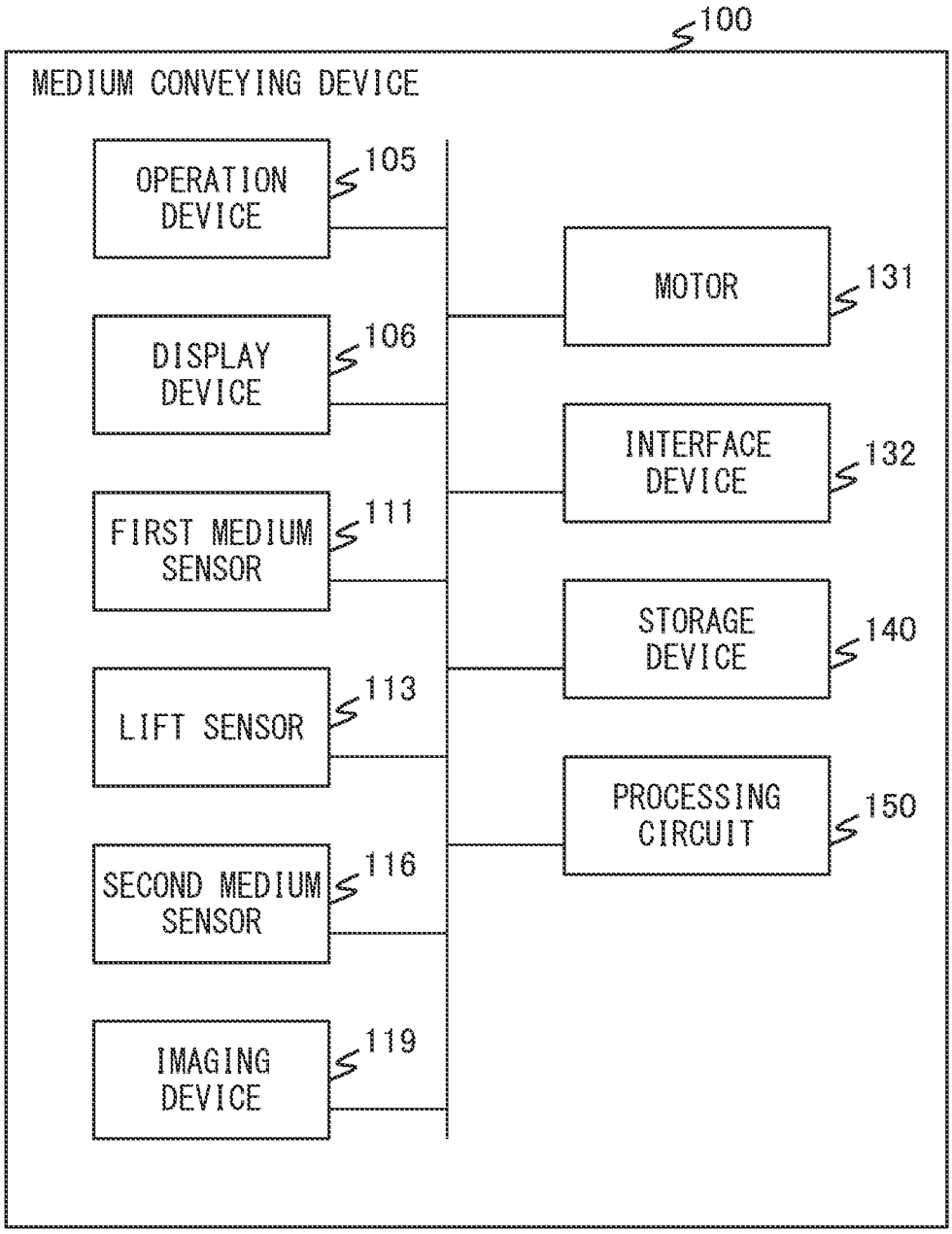
FIG. 5 is a block diagram illustrating an example of a schematic configuration of the medium conveying apparatus 100.

FIG. 5 is a block diagram illustrating an example of a schematic configuration of the medium conveying apparatus 100. In addition to the configuration described above, the medium conveying apparatus 100 further includes a motor 131, an interface device 132, a storage device 140, and a processing circuit 150.

The motor 131 includes one or a plurality of motors. The motor 131 feeds and conveys a medium by rotating the pick roller 112, the feed roller 114, the brake roller 115, and the first to eighth conveyance rollers 117*a* to 117*h* in accordance with a control signal from the processing circuit 150. The first to eighth driven rollers 118*a* to 118*h* may be provided to rotate by a driving force from a motor instead of being driven to rotate according to rotation of the conveyance rollers.

The interface device 132 includes an interface circuit conforming to a serial bus such as USB The interface device 132 transmits and receives read images and various types of information by being electrically connected to an unillustrated information processing device (such as a personal computer or a mobile information terminal). A communication unit including an antenna transmitting and receiving wireless signals and a wireless communication interface circuit for transmitting and receiving signals through a wireless communication line in conformance with a predetermined communication protocol may be used in place of the interface device 132. Examples of the predetermined communication protocol include a wireless local area network (LAN).

The storage device 140 includes a memory device such as a random access memory (RAM) or a read only memory (ROM), a fixed disk device such as a hard disk, or a portable storage device such as a flexible disk or an optical disk. The storage device 140 stores a computer program, a database, a table, and the like that are used for various types of processing in the medium conveying apparatus 100. The computer program may be installed on the storage device 140 from a non-transitory computer-readable portable storing medium by a known setup program. Examples of the portable recording medium include a compact disc read only memory (CD-ROM) and a digital versatile disc read only memory (DVD-ROM).

The processing circuit 150 is a circuit operating in accordance with a program previously stored in the storage device 140. Examples of the processing circuit 150 include a central processing unit (CPU). The processing circuit 150 may be a digital signal processor (DSP), a large scale integration (LSI), an application specific integrated circuit (ASIC), a field-programmable gate array (FPGA) or the like.

The processing circuit 150 is connected to the operation device 105, the display device 106, the first medium sensor 111, the lift sensor 113, the second medium sensor 116, the imaging device 119, the motor 131, the interface device 132, and the storage device 140, and controls these components. The processing circuit 150 conveys a medium by controlling the motor 131, acquires an input image by controlling the imaging device 119, and transmits the acquired input image to the information processing device through the interface device 132. The processing circuit 150 determines whether or not a conveyed medium is a bound medium on the basis of a lift detection signal received from the lift sensor 113 and a second medium signal received from the second medium sensor 116.

Figure 6:
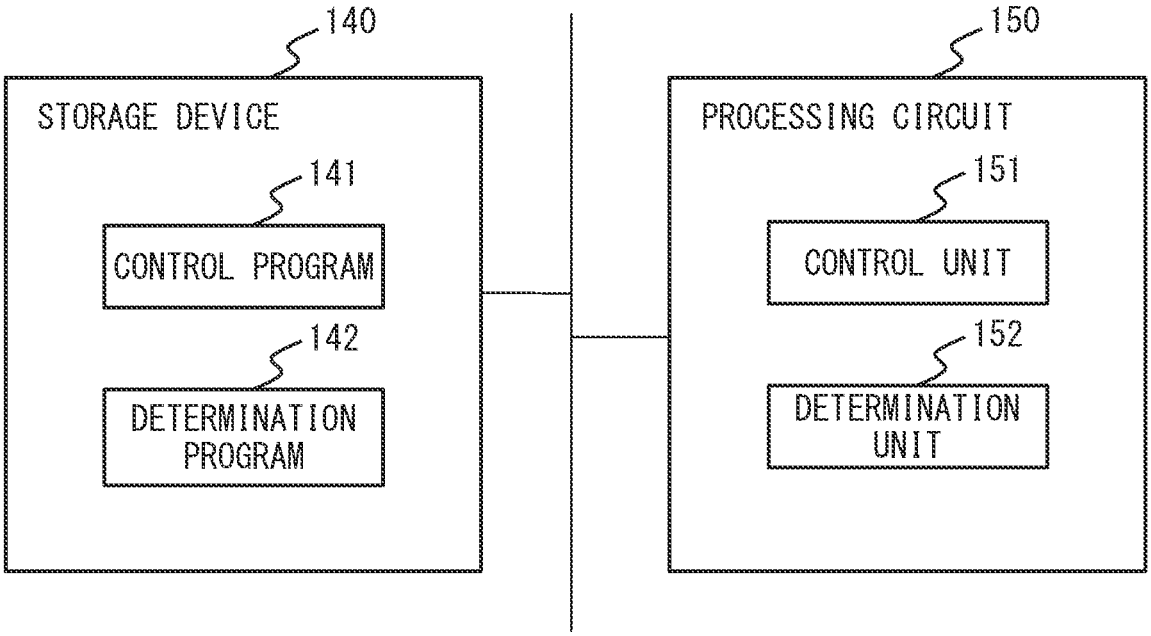
FIG. 6 is a block diagram illustrating an example of schematic configurations of a storage device 140 and a processing circuit 150.

FIG. 6 is a diagram illustrating schematic configurations of the storage device 140 and the processing circuit 150.

The storage device 140 stores programs such as a control program 141 and a determination program 142. Each of the programs is a functional module implemented by software operating on a processor. The processing circuit 150 functions as a control unit 151 and a determination unit 152 by reading each program stored in the storage device 140 and operating in accordance with the read program.

Figure 7:
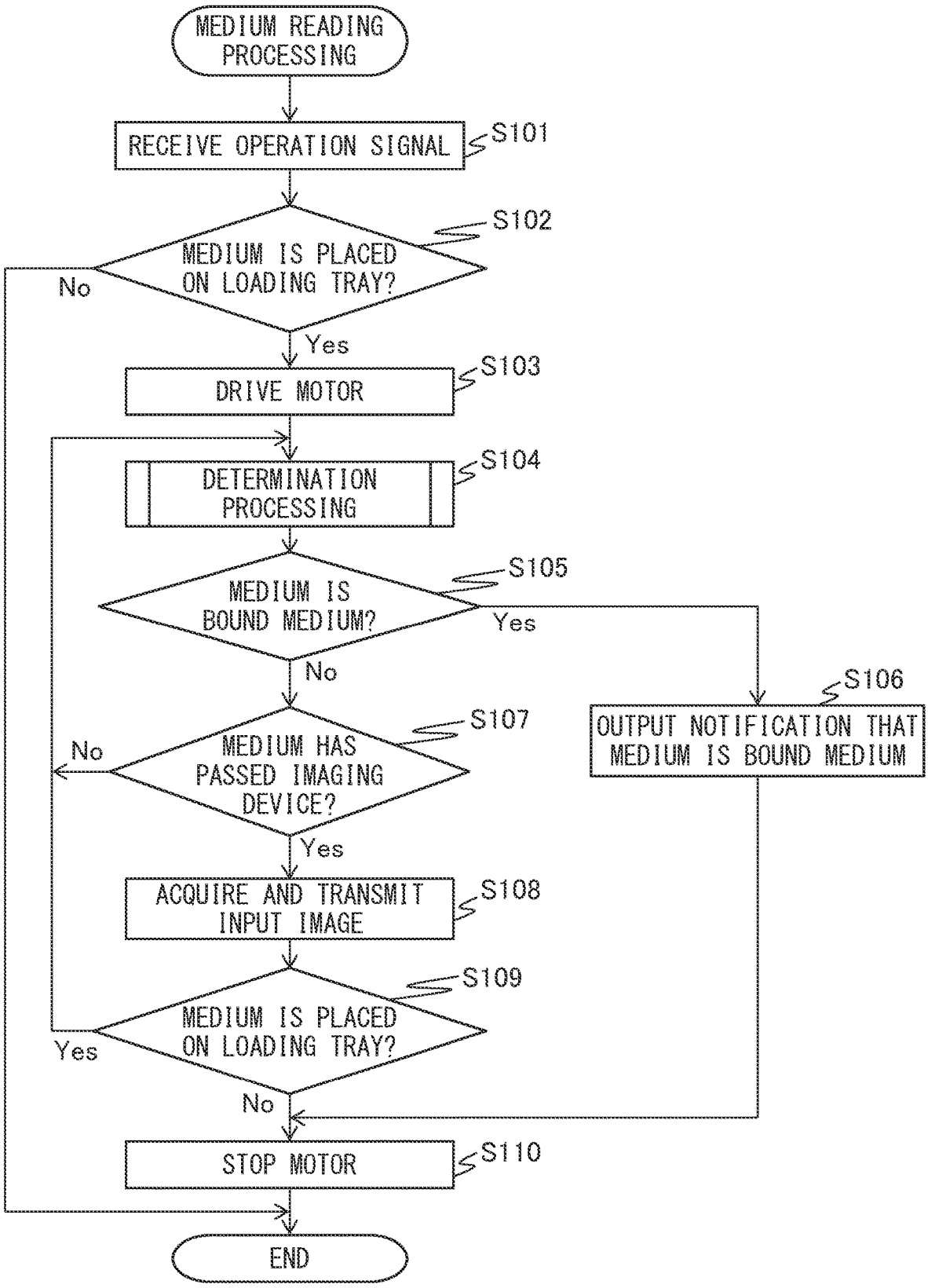
FIG. 7 is a flowchart illustrating an example of a flow of medium reading processing.

FIG. 7 is a flowchart illustrating an operation example of medium reading processing executed by the medium conveying apparatus 100. The medium reading processing is achieved by cooperation between the processing circuit 150 and the components in the medium conveying apparatus 100 in accordance with a program stored in the storage device 140.

First, the control unit 151 stands by until an operation signal instructing to read a medium is received (S101). The operation signal is provided to the control unit 151 from the operation device 105 in response to input of a read instruction of a medium to the operation device 105 by a user. The operation signal may be provided from the information processing device through the interface device 132 in response to input of a read instruction to the information processing device by a user.

Next, the control unit 151 determines whether or not a medium is placed on the loading tray 103 on the basis of a first medium signal output from the first medium sensor 111 (S102). When a medium is not placed (S102—No), the control unit 151 ends the medium reading processing.

When a medium is placed (S102—Yes), the control unit 151 raises the loading tray 103 to a position allowing feed of the medium by driving a motor for moving the loading tray 103. The control unit 151 feeds and conveys the medium placed on the loading tray 103 by rotating the pick roller 112, the feed roller 114, the brake roller 115, and the first to eighth conveyance rollers 117*a* to 117*h* by driving the motor 131 (S103).

Next, the determination unit 152 executes determination processing (S104). The determination unit 152 determines whether or not a conveyed medium is a bound medium, or the like in the determination processing. Details of the determination processing will be described later.

Next, the control unit 151 determines whether or not the conveyed medium is determined to be a bound medium in the determination processing (S105). When the conveyed medium is determined to be a bound medium (S105—Yes), the control unit 151 outputs a notification that the conveyed medium is a bound medium (S106). The control unit 151 outputs the notification by causing the display device 106 to display the notification and notifies to a user. The control unit 151 may output the notification by transmitting a notification signal indicating that the conveyed medium is a bound medium to the information processing device through the interface device 132 and notify the user. Next, the control unit 151 stops conveyance of the medium by stopping the motor 131 (S110) and ends the medium reading processing. Note that outputting a notification that a conveyed medium is a bound medium and stopping conveyance of the medium constitute an example of abnormality processing.

By stopping conveyance of a medium when a bound medium is conveyed, the control unit 151 can suppress occurrence of a medium jam and occurrence of damage to the medium. Further, the control unit 151 can suppress a binder binding the medium, such as a staple or a clip, entering the conveyance path of the medium and damaging a glass surface or the like of the imaging device 119. Consequently, the user does not need to confirm whether or not a medium to be conveyed is bound by a staple before conveyance of the medium. Therefore, the medium conveying apparatus 100 can improve user convenience and reduce the processing time of the medium reading processing at the same time.

When the conveyed medium is determined not to be a bound medium (S105—No), the control unit 151 determines whether or not the rear edge of the medium has passed the imaging position of the imaging device 119 (S107). For example, the control unit 151 periodically acquires a second medium signal from the second medium sensor 116 and determines that the rear edge of the medium has passed the position of the second medium sensor 116 when the signal value of the second medium signal changes from a value indicating existence of a medium to a value indicating nonexistence of a medium. When a predetermined time elapses after the rear edge of the medium passes the position of the second medium sensor 116, the control unit 151 determines that the rear edge of the medium has passed the imaging position. The predetermined time is set to a time acquired by adding a margin to the time required for the medium to be conveyed from the second medium sensor 116 to the imaging position. When the rear edge of the medium has not yet passed the imaging position (S107—No), the control unit 151 returns the processing to S104 and repeats the processing in S104 to S107.

When the rear edge of the medium has passed the imaging position (S107—Yes), the control unit 151 acquires an input image from the imaging device 119. The control unit 151 transmits the acquired input image to the information processing device through the interface device 132 (S108).

Next, the control unit 151 determines whether or not a medium is placed on the loading tray 103 on the basis of a first medium signal output from the first medium sensor 111 (S109). When a medium is placed (S109—Yes), the control unit 151 returns the processing to S104 and repeats the processing in S104 to S109. When a medium is not placed (S109—No), the control unit 151 stops the motor 131 (S110) and ends the medium reading processing.

Figure 8:
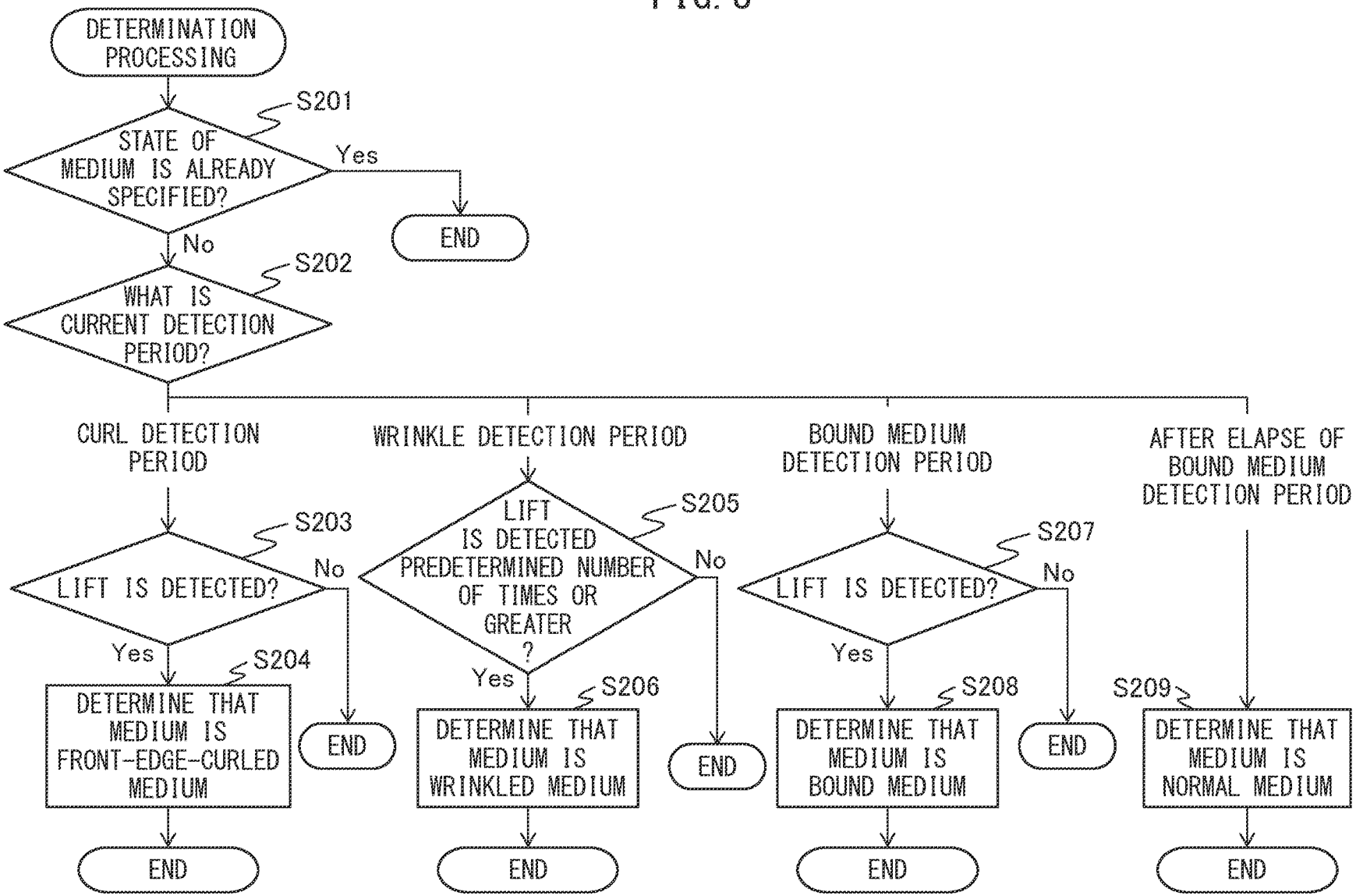
FIG. 8 is a flowchart illustrating an example of a flow of determination processing.

FIG. 8 is a flowchart illustrating an operation example of the determination processing. The determination processing is executed in S104 in the medium reading processing.

First, the determination unit 152 determines whether or not a state of a fed medium is already specified (S201). When the state of the medium is already specified, the determination unit 152 ends the determination processing.

When the state of the medium is not yet specified, the determination unit 152 specifies a kind of a current detection period (S202). When a first time has not elapsed after starting feed of the medium, in other words, after starting rotation of the pick roller 112, the determination unit 152 determines that the current detection period is a curl detection period. The first time is set to the time required for the front edge of the medium to move from the position of the downstream edge of the loading tray 103 to the upstream edge of the roller nip 114*a* of the feed roller 114, or a time shorter than the required time. The determination unit 152 may calculate an elapse of time on the basis of a drive amount of which the control unit 151 drives the motor 131. The front edge of a medium refers to an edge of the medium in the downstream side. Specifically, the curl detection period is set to a period from a start of rotation of the pick roller 112 to a time point before or when the front edge of a medium fed by the pick roller 112 arrives at the upstream edge of the roller nip 114*a* of the feed roller 114. The curl detection period is an example of a second predetermined period from a start of rotation of the pick roller 112 to a time point before arrival detection of a medium by the second medium sensor 116.

The determination unit 152 may detect a timing when rotation of the pick roller 112 starts by an unillustrated roller encoder. A roller encoder includes a disk being provided in such a way as to rotate in conjunction with rotation of the pick roller 112 and being provided with a plurality of slits along the outer periphery of the disk, and a light emitter and a light receiver provided in such a way as to face each other with the disk in between. The light emitter is an LED or the like and projects light to the disk and the light receiver. The light receiver is a photodiode or the like, detects light projected by the light emitter, and outputs current based on intensity of the light. When the pick roller 112 and the disk are rotating, switching between a state in which light from the light emitter is interrupted by the disk and a state in which light from the light emitter passes a slit on the disk and is detected by the light receiver is occurred, and therefore a current value output by the light receiver changes. Accordingly, the determination unit 152 can detect rotation of the pick roller 112 on the basis of a change in the current value output by the light receiver in the roller encoder.

When the curl detection period elapses and the front edge of the medium is not detected by the second medium sensor 116, the determination unit 152 determines that the current detection period is a wrinkle detection period. The determination unit 152 determines whether or not the front edge of the medium in the conveying direction A2 is detected by the second medium sensor 116. The determination unit 152 periodically acquires a second medium signal from the second medium sensor 116 and determines that the front edge of the medium is detected by the second medium sensor 116 when the signal value of each second medium signal changes from a value indicating nonexistence of a medium to a value indicating existence of a medium. Specifically, the wrinkle detection period is set to a period from a time point before or when the front edge of a medium fed by the pick roller 112 passes the upstream edge of the roller nip 114*a* of the feed roller 114 to arrival of the front edge at the position of the second medium sensor 116. The wrinkle detection period is a period after elapse of the curl detection period and before a bound medium detection period to be described later.

When a second time has not elapsed after the elapse of the wrinkle detection period, the determination unit 152 determines that the current detection period is a bound medium detection period. The second time is set to, for example, the maximum time required for a lift of a medium to occur after the front edge of the medium passes the position of the second medium sensor 116 when a medium with bound front edge is fed. The second time is appropriately set on the basis of the size of a medium in the medium conveying direction A2 that the medium conveying apparatus 100 is conveyable, the length of the arm 113*a* in the medium conveying direction A2, and the like. The second time is set to, for example, a time required for a medium to move any distance of 30 mm or more and 100 mm or less. Specifically, the bound medium detection period is set to a predetermined period after the front edge of a medium fed by the pick roller 112 passes the position of the second medium sensor 116. The bound medium detection period is an example of a first predetermined period after the front edge of a medium in the conveying direction A2 is detected by the second medium sensor 116.

When the current detection period is the curl detection period, the determination unit 152 determines whether or not a lift of the medium is detected by any lift sensor 113 (S203). The determination unit 152 acquires a lift signal from each lift sensor 113. When the signal value of any lift signal is greater than or equal to a lift threshold value, the determination unit 152 determines that a lift of the medium is detected by the lift sensor 113. The lift threshold value is a value between the signal value of a lift signal output from the photodetector 113*f* when the arm 113*a* in the lift sensor 113 interrupts light from the light-emitting element 113*e* and the signal value of a lift signal output from the photodetector 113*f* when light from the light-emitting element 113*e* is directly received by the photodetector 113*f*.

When a lift is detected in the curl detection period (S203—Yes), the determination unit 152 determines that the medium is a front-edge-curled medium instead of a bound medium (S204) and ends the determination processing. A bound medium refers to a medium acquired by binding a plurality of media at the front edge by a binder such as a staple, a string, or a clip. A front-edge-curled medium refers to a medium of which front edge (i.e., at one end or a region across the entire width in the width direction A4) is curved or crooked upward. In other words, when a lift of the medium is detected in the curl detection period, the determination unit 152 determines that the medium is not a bound medium regardless of whether or not a lift of the medium is detected in the bound medium detection period. When a lift is not detected (S203—No), the determination unit 152 ends the determination processing without specifying the state of the medium as yet.

When the current detection period is the wrinkle detection period, the determination unit 152 determines whether or not a lift of the medium is detected a predetermined number of times or greater by any lift sensor 113 in the wrinkle detection period (S205). When the signal value of a lift signal output from any lift sensor 113 changes from a value less than the lift threshold value to a value greater than or equal to the lift threshold value the predetermined number of times or greater in the wrinkle detection period, the determination unit 152 determines that a lift of the medium is detected the predetermined number of times or greater. The predetermined number of times is any number of times greater than or equal to twice and is, for example, three times.

When a lift of the medium is detected the predetermined number of times or greater in the wrinkle detection period (S205—Yes), the determination unit 152 determines that the medium is a wrinkled medium instead of a bound medium (S206) and ends the determination processing. A wrinkled medium refers to a medium of which a plurality of parts other than the front edge is crooked upward. On the other hand, when a lift is not yet detected the predetermined number of times or greater (S205—No), the determination unit 152 ends the determination processing without specifying the state of the medium as yet.

When the current detection period is the bound medium detection period, the determination unit 152 determines whether or not a lift of the medium is detected (S207).

When a lift of the medium is detected in the bound medium detection period (S207—Yes), the determination unit 152 determines that the medium is a bound medium (S208) and ends the determination processing. When a lift of the medium is not detected in the bound medium detection period (S207—No), the determination unit 152 ends the determination processing without specifying the state of the medium as yet.

When the current detection period is after the elapse of the bound medium detection period, the determination unit 152 determines that the medium is a normal medium without determining whether or not the medium is a bound medium (S209) and ends the determination processing. A normal medium refers to a medium being none of a bound medium, a wrinkled medium, and a front-edge-curled medium.

Figure 9:
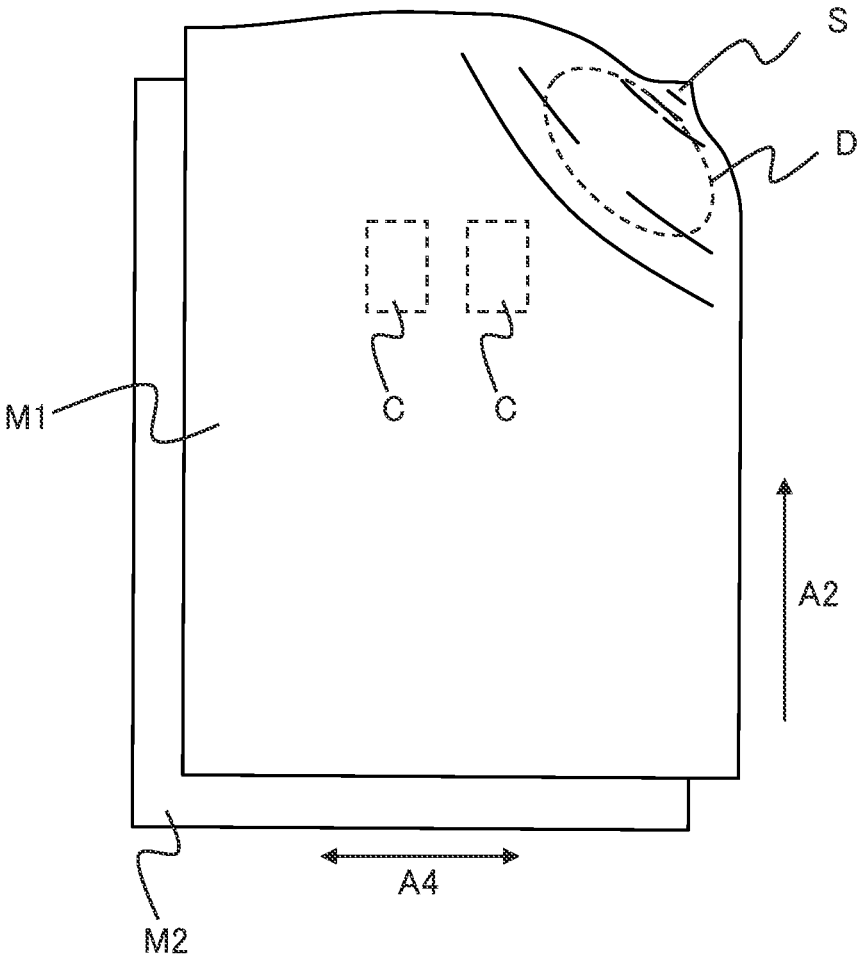
FIG. 9 is a diagram for illustrating a lift of a bound medium.

FIG. 9 is a diagram for illustrating a lift occurring when a bound medium is fed by the feed roller 114. FIG. 9 is a top view illustrating a state in which the front edge of a bound medium passes a separation part (i.e., the feed roller 114 and the brake roller 115) and arrives at the position of the second medium sensor 116 and a lift of the bound medium occurs.

When the front edge of the bound medium passes the separation part, a medium M1 in the bound medium, which is bound on the upper side and in contact with the feed roller 114, receives a force pushing out the medium toward the downstream side at a contact position C with the feed roller 114. On the other hand, a medium M2 not in contact with the feed roller 114 receives a force pushing out the medium toward the upstream side by the brake roller 115 and therefore receives a force pushing out the medium toward the upstream side at a binding position S. Consequently, as illustrated in FIG. 9, a lift D occurs in a region between the contact position C of the medium M1 with the feed roller 114 and the binding position S.

The lift D mostly occurs at a position outside the feed roller 114 in the width direction A4. Accordingly, the lift D is detected by the lift sensor 113 provided outside the feed roller 114 in the width direction A4.

Figure 10A:
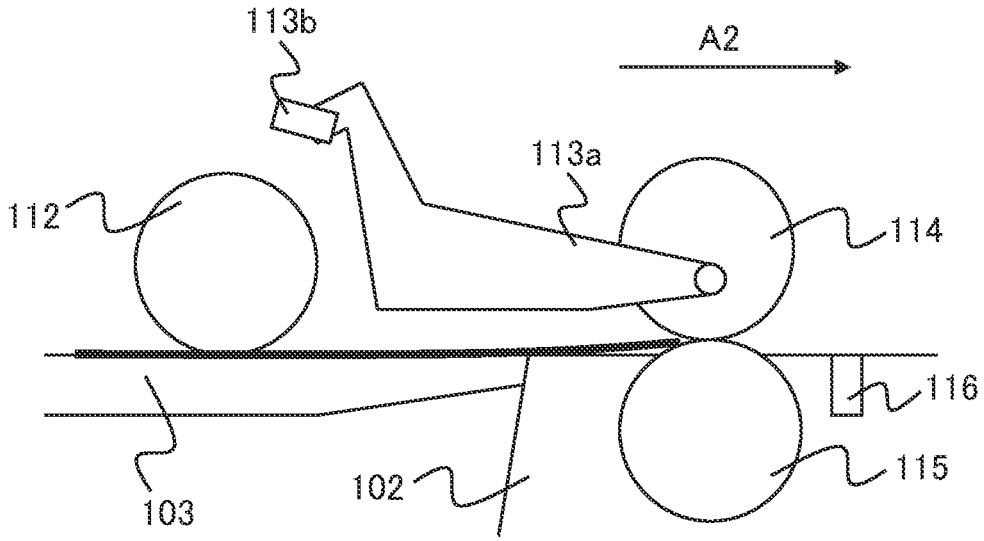
FIG. 10A is a diagram for illustrating detection of a bound medium.
Figure 10B:
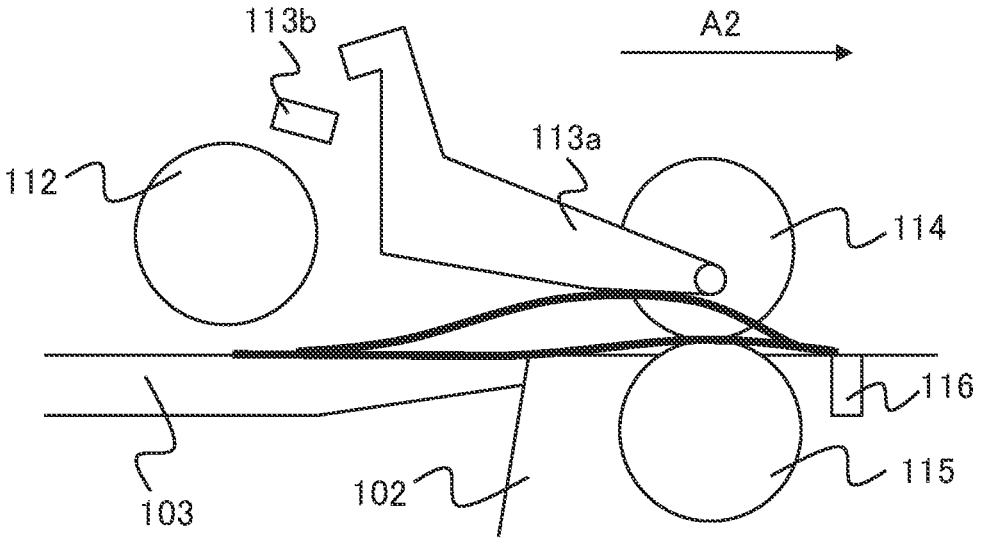
FIG. 10B is a diagram for illustrating detection of a bound medium.

FIG. 10A and FIG. 10B are schematic diagrams for illustrating detection of a bound medium. FIG. 10A is a side view of a state before a bound medium arrives at the position of the feed roller 114. As illustrated in FIG. 10A, a lift of the bound medium does not occur in the state before the bound medium arrives at the position of the feed roller 114.

FIG. 10B is a diagram illustrating a state in which time elapsed from the state illustrated in the FIG. 10A and the front edge of the bound medium passed the separation part and was detected by the second medium sensor 116. As described with FIG. 9, when the front edge of the bound medium passes the separation part, a lift occurs at a position outside the feed roller 114 in the width direction A4. Consequently, the arm 113*a* in the lift sensor 113 is pushed up and the photodetector 113*f* in the horseshoe-shaped sensor 113*b* receives light from the light-emitting element 113*e*, and therefore a lift of the medium is detected.

Specifically, when a bound medium is fed, a lift is not detected before the front edge of the medium arrives at the position of the second medium sensor 116 placed on the downstream side of the separation part, and a lift is detected after the front edge of the medium arrives at the position of the second medium sensor 116. Accordingly, the medium is determined to be a bound medium in S208 in the determination processing.

Figure 11:
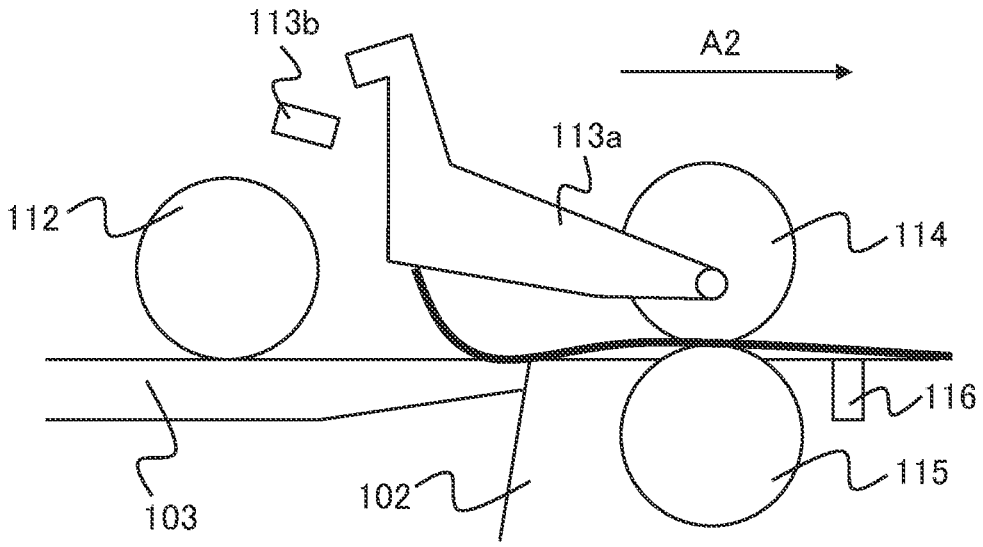
FIG. 11 is a diagram for illustrating detection of a rear-edge-curled medium.

FIG. 11 is a schematic diagram for illustrating detection of a rear-edge-curled medium. A rear-edge-curled medium refers to a medium of which the rear edge (at one end or a region across the entire width in the width direction A4) facing the front edge is curved or crooked upward. FIG. 11 is a diagram illustrating a state in which further time has elapsed after detection of the front edge of the rear-edge-curled medium by the second medium sensor 116.

As illustrated in FIG. 11, when the front edge of a rear-edge-curled medium passes the position of the second medium sensor 116 and is further conveyed, the rear edge of the medium comes into contact with the lower part of the arm 113*a* in the lift sensor 113. Consequently, the arm 113*a* is pushed up by the rear edge of the medium and the photodetector 113*f* receives light from the light-emitting element 113*e* in the horseshoe-shaped sensor 113*b*, and therefore a lift of the medium is detected.

Thus, when a rear-edge-curled medium is fed, a lift is detected after the front edge of the medium arrives at the position of the second medium sensor 116 and the rear edge of the medium further arrives at the lower part of the arm 113*a*. By setting the bound medium detection period to a period after arrival of the front edge of the medium at the position of the second medium sensor 116 and before arrival of the rear edge of the medium at the lower part of the arm 113*a*, a determination of whether or not a medium is a bound medium is not made for the rear-edge-curled medium in S209 in the determination processing. Accordingly, the medium conveying apparatus 100 can suppress erroneous determination that the rear-edge-curled medium is a bound medium.

Figure 12A:
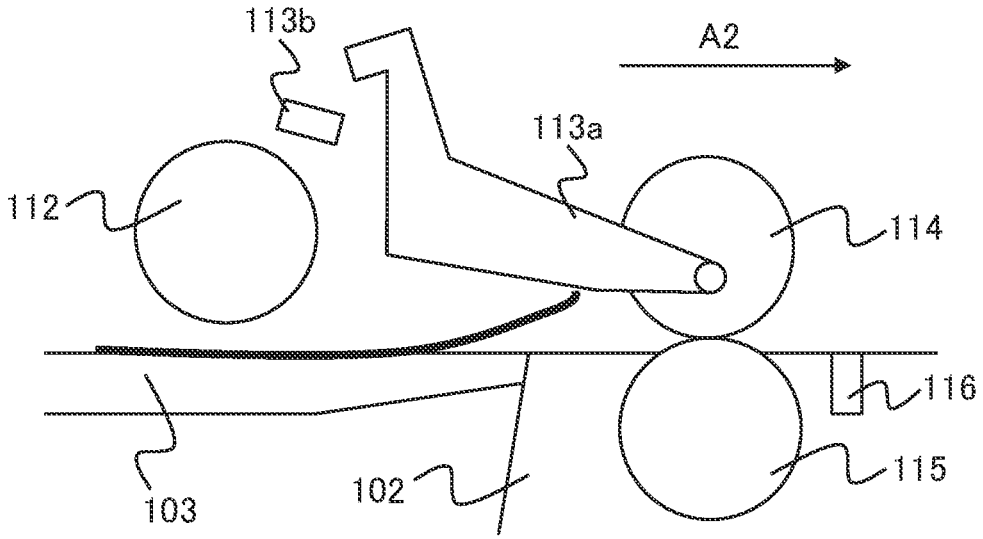
FIG. 12A is a diagram for illustrating detection of a front-edge-curled medium.
Figure 12B:
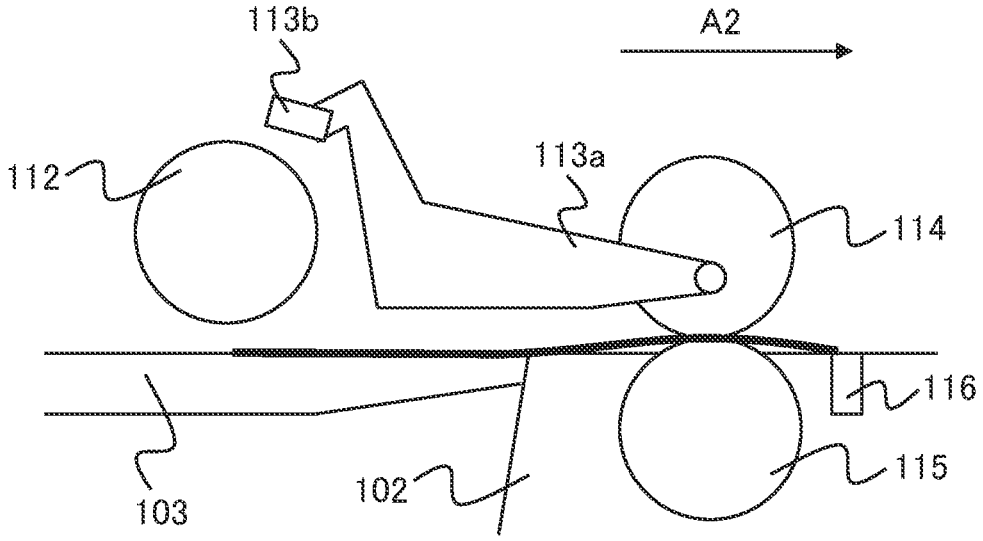
FIG. 12B is a diagram for illustrating detection of a front-edge-curled medium.

FIG. 12A and FIG. 12B are schematic diagrams for illustrating detection of a front-edge-curled medium. FIG. 12A is a side view of a state before the front edge of a front-edge-curled medium arrives at the position of the feed roller 114. As illustrated in FIG. 12A, the arm 113*a* in the lift sensor 113 is pushed up by the front edge of the front-edge-curled medium before the medium arrives at the position of the feed roller 114, and a lift of the medium is detected.

FIG. 12B is a diagram illustrating a state in which time elapsed from the state illustrated in FIG. 12A and the front edge of the front-edge-curled medium passed the separation part and was detected by the second medium sensor 116. Only the front edge of the front-edge-curled medium is curved or crooked upward, and the front edge of the front-edge-curled medium is pressed down by the separation part when passing the separation part, and therefore a lift of the medium is not detected after the medium arrives at the position of the second medium sensor 116.

Figure 13:
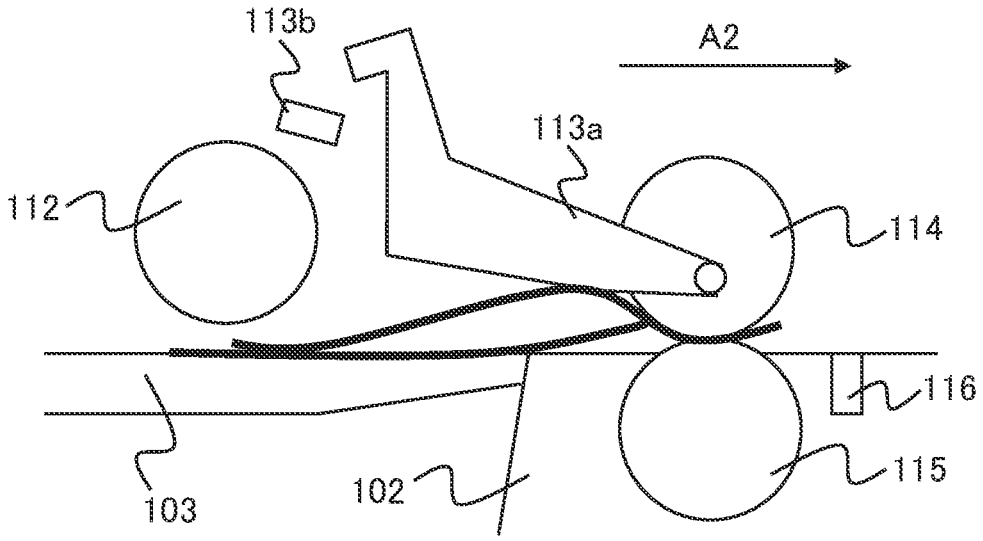
FIG. 13 is a diagram for illustrating detection of a front-edge-curled medium.

FIG. 13 is a diagram illustrating a state in which a plurality of front-edge-curled media are fed in a stacked manner and the front edge of a medium in contact with the feed roller 114 passes the separation part. In this case, the medium passing the separation part is push up by a medium not in contact with the feed roller 114, and a lift of the medium may be detected after the front edge passes the separation part and arrives at the position of the second medium sensor 116.

When a front-edge-curled medium is fed, a lift is detected before the front edge of the medium arrives at the position of the second medium sensor 116. Accordingly, the front-edge-curled medium is detected in S204 in the determination processing. When a front-edge-curled medium is fed, a lift may or may not be detected after the front edge of the medium arrives at the position of the second medium sensor 116. The determination unit 152 can suppress erroneous determination that the front-edge-curled medium is a bound medium by determining that the medium is not a bound medium regardless of whether or not a lift of the medium is detected in the bound medium detection period when a lift of a medium is detected in the curl detection period. The medium conveying apparatus 100 can suppress erroneous stopping of feed of the medium when a front-edge-curled medium is fed, and can suppress increase in the time required for the medium reading processing.

Figure 14A:
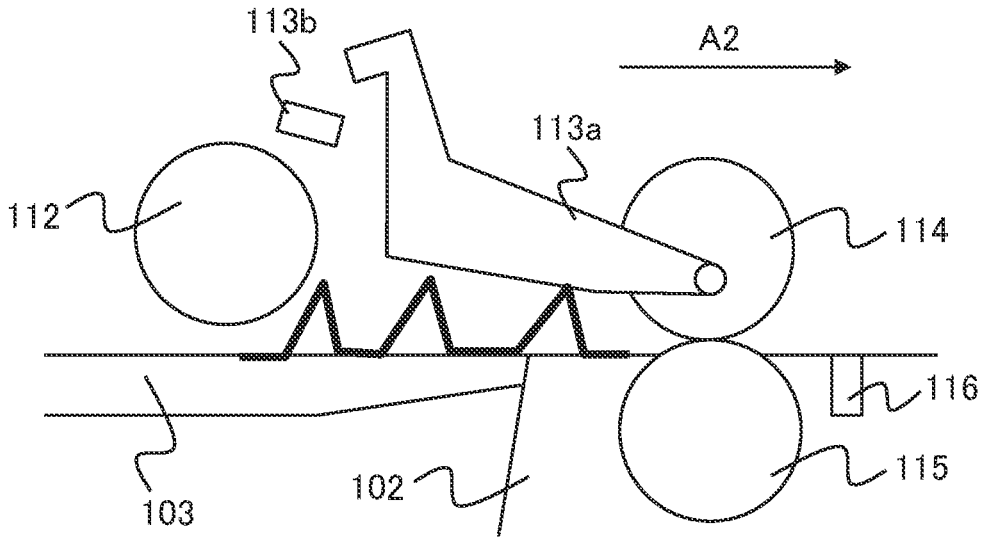
FIG. 14A is a diagram for illustrating detection of a wrinkled medium.
Figure 14B:
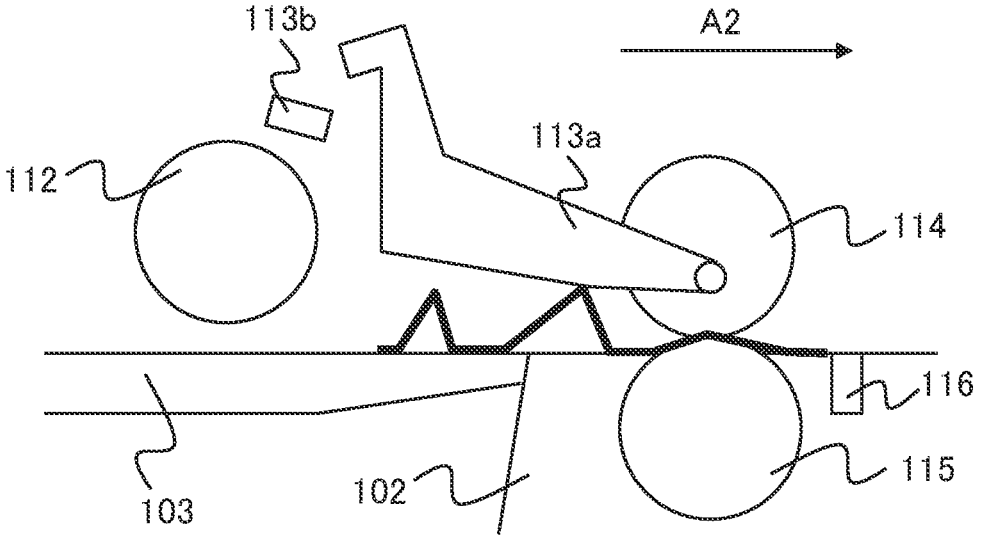
FIG. 14B is a diagram for illustrating detection of a wrinkled medium.

FIG. 14A and FIG. 14B are schematic diagrams for illustrating detection of a wrinkled medium. FIG. 14A is a side view of a state before the front edge of a wrinkled medium arrives at the position of the feed roller 114. As illustrated in FIG. 14A, the arm 113*a* in the lift sensor 113 is pushed up by a part of the wrinkled medium crooked upward, and the photodetector 113*f* receives light from the light-emitting element 113*e* in the horseshoe-shaped sensor 113*b* before the medium arrives at the position of the feed roller 114, and therefore a lift of the medium is detected.

FIG. 14B is a diagram illustrating a state in which time elapsed from the state illustrated in FIG. 14A. A plurality of parts of a wrinkled medium are crooked upward, and therefore a lift of the medium is detected a plurality of times before the front edge of the wrinkled medium arrives at the position of the second medium sensor 116.

Thus, when a wrinkled medium is fed, a lift is detected a plurality of times before the front edge of the medium arrives at the position of the feed roller. A part of a wrinkled medium other than the front edge is crooked upward, and therefore a lift of a wrinkled medium is detected later than a lift of a front-edge-curled medium. Accordingly, a wrinkled medium is detected in S206 in the determination processing. The determination unit 152 can suppress erroneous determination that a wrinkled medium is a bound medium by determining that the medium is not a bound medium when a lift of the medium is detected a plurality of times in the wrinkle detection period. Consequently, the medium conveying apparatus 100 can suppress erroneous stopping of feeding of the medium when a wrinkled medium is fed, and can suppress increase in the time required for the medium reading processing.

The determination unit 152 can suppress erroneous determination that a bound medium is fed when a front-edge-curled medium, a wrinkled medium, or a rear-edge-curled medium is fed and can improve detection precision of a bound medium. Consequently, if a detection function of a bound medium is provided in an ON/OFF switchable manner, the medium conveying apparatus 100 allows a default setting of the function to be ON and can improve user convenience.

As described above, when a lift of a medium is detected by the lift sensor 113 in the bound medium detection period, the medium conveying apparatus 100 according to the embodiment determines that the medium is a bound medium. Consequently, the medium conveying apparatus 100 enables suitable detection of a bound medium.

Further, by detecting a lift of the front edge of a medium, the medium conveying apparatus 100 can detect that a medium is a bound medium earlier than a case of detecting that the rear edge of the medium runs onto a side guide provided on the loading tray 103. Accordingly, when a bound medium is fed, the medium conveying apparatus 100 can stop feeding of the medium early and can suppress occurrence of damage to the medium.

Further, when a lift of a medium is detected in the curl detection period from a start of rotation of the pick roller 112 to a time point before arrival detection of the medium by the second medium sensor 116, the medium conveying apparatus 100 determines that the medium is a front-edge-curled medium. In this case, the medium conveying apparatus 100 determines that the medium is not a bound medium regardless of whether or not a lift of the medium is detected in the bound medium detection period. Consequently, the medium conveying apparatus 100 can appropriately distinguish and detect a front-edge-curled medium and a bound medium.

Further, when a lift of a medium is detected predetermined number of times or greater in the wrinkle detection period after elapse of the curl detection period and before the bound medium detection period, the medium conveying apparatus 100 determines that the medium is a wrinkled medium. In this case, the medium conveying apparatus 100 determines that the medium is not a bound medium regardless of whether or not a lift of the medium is detected in the bound medium detection period. Consequently, the medium conveying apparatus 100 can appropriately distinguish and detect a wrinkled medium and a bound medium.

Further, the medium conveying apparatus 100 does not determine whether or not a medium is a bound medium after elapse of the bound medium detection period. Consequently, the medium conveying apparatus 100 can suppress erroneous determination that a bound medium is fed when a rear-edge-curled medium is fed.

Further, the horseshoe-shaped sensor 113*b* in the medium conveying apparatus 100 detects a lift of a medium by detecting a rise of the arm 113*a* placed in such a way as to be raised according to a lift of a medium. Consequently, the medium conveying apparatus 100 can satisfactory detect a lift of a medium.

Further, the arm 113*a* in the medium conveying apparatus 100 is formed in such a way as to interrupt light from the light-emitting element 113*e* in the horseshoe-shaped sensor 113*b* in an unraised state and passes the light from light-emitting element 113*e* to the photodetector 113*f* in a raised state. Consequently, when the light-emitting element 113*e* cannot normally project light or when the photodetector 113*f* cannot normally detect light, a lift is not detected and in the determination processing, it is determined that a normal medium is conveyed. Accordingly, the medium conveying apparatus 100 does not stop conveyance when an abnormality occurs in the light-emitting element 113*e* or the photodetector 113*f* and can improve user convenience. The arm 113*a* may be formed in such a way as to interrupt light from the light-emitting element 113*e* in the horseshoe-shaped sensor 113*b* in the raised state and pass light from the light-emitting element 113*e* to the photodetector 113*f* in the unraised state.

Further, each of the lift sensors 113 in the medium conveying apparatus 100 is provided outside the pick roller 112 and the feed roller 114 in the width direction A4. Consequently, the medium conveying apparatus 100 can appropriately detect a lift of a general bound medium.

Figure 15:
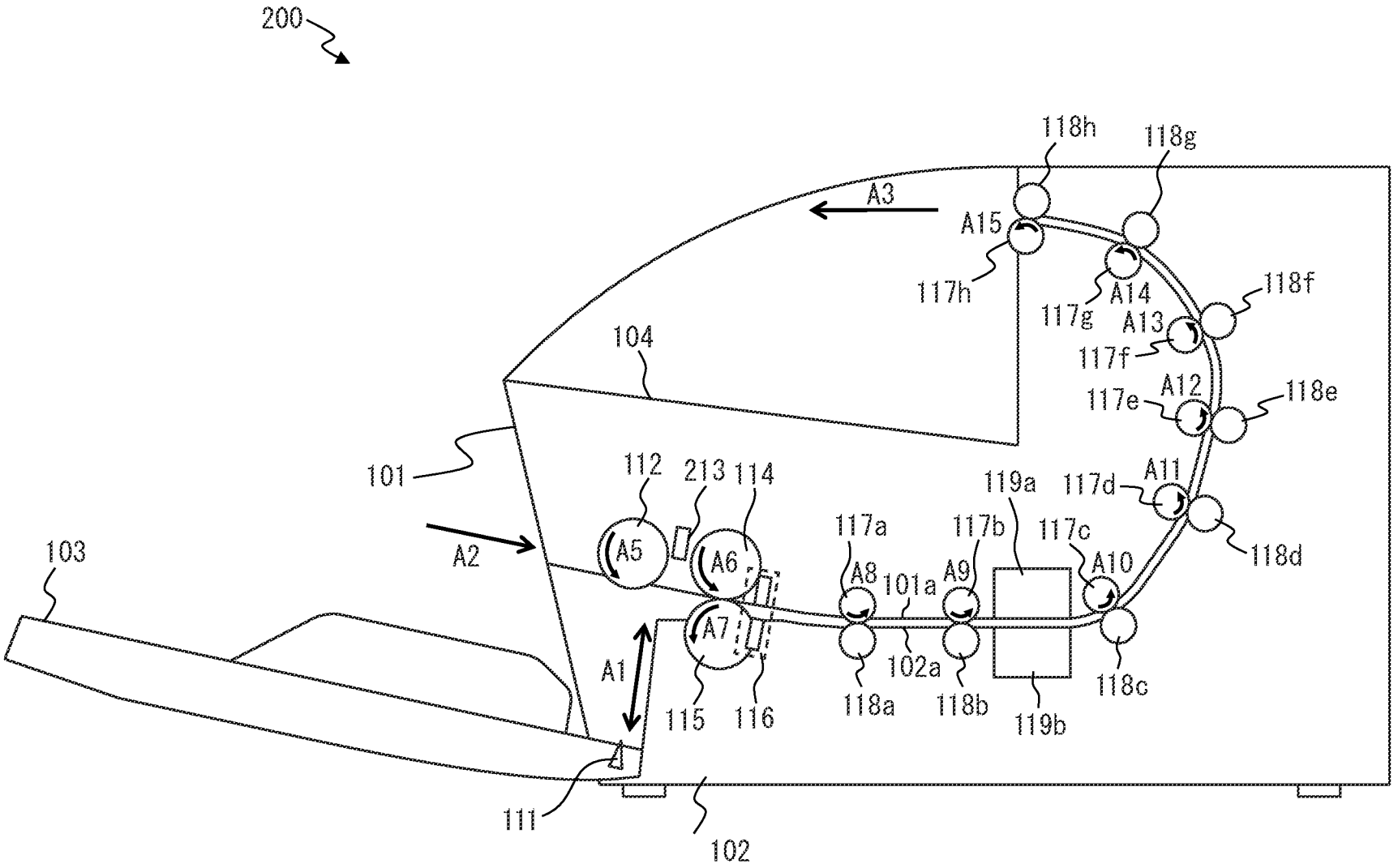
FIG. 15 is a schematic diagram for illustrating a conveyance path in a medium conveying apparatus 200.

FIG. 15 is a diagram for illustrating a conveyance path inside a medium conveying apparatus 200 according to another embodiment. The medium conveying apparatus 200 includes a lift sensor 213 in place of the lift sensor 113.

The lift sensor 213 is placed inside a first housing 101 on the downstream side of a pick roller 112 and on the upstream side of a feed roller 114 in a medium conveying direction A2 and outside the pick roller 112 and the feed roller 114 in a width direction A4. The lift sensor 213 includes a range sensor. The range sensor is provided above a conveyance path of a medium and detects a lift of a medium by measuring the distance to the medium. The range sensor includes a light-emitting element and a photodetector. The light-emitting element is an LED or the like and projects light toward a fed medium. The photodetector receives light being projected from the light-emitting element and being reflected by a fed medium. The range sensor measures the distance to a medium on the basis of the time between projection of light by the light-emitting element and detection of the light by the photodetector. The range sensor detects a lift of a medium when a measured distance is less than or equal to a predetermined distance. The predetermined distance is set to a distance acquired by subtracting a margin from the distance from the range sensor to a maximum bendable height of a medium during feed of the medium. The lift sensor 213 generates and outputs an electric signal according to a detected distance as a lift detection signal. The lift sensor 213 may include a plurality of range sensors in such a way as to be able to detect a lift of a medium occurring at any location between the upstream side of a roller nip 112*a* of the pick roller 112 and the downstream side of roller nips 114*a* of the feed roller 114 and a brake roller 115.

Further, while the feed roller 114 is placed above the brake roller 115, and media placed on the loading tray 103 are sequentially fed from the upper side, according to the aforementioned embodiment, the feed roller may be placed below the brake roller in such a way that media placed on the loading tray are sequentially fed from the lower side.

Figure 16:
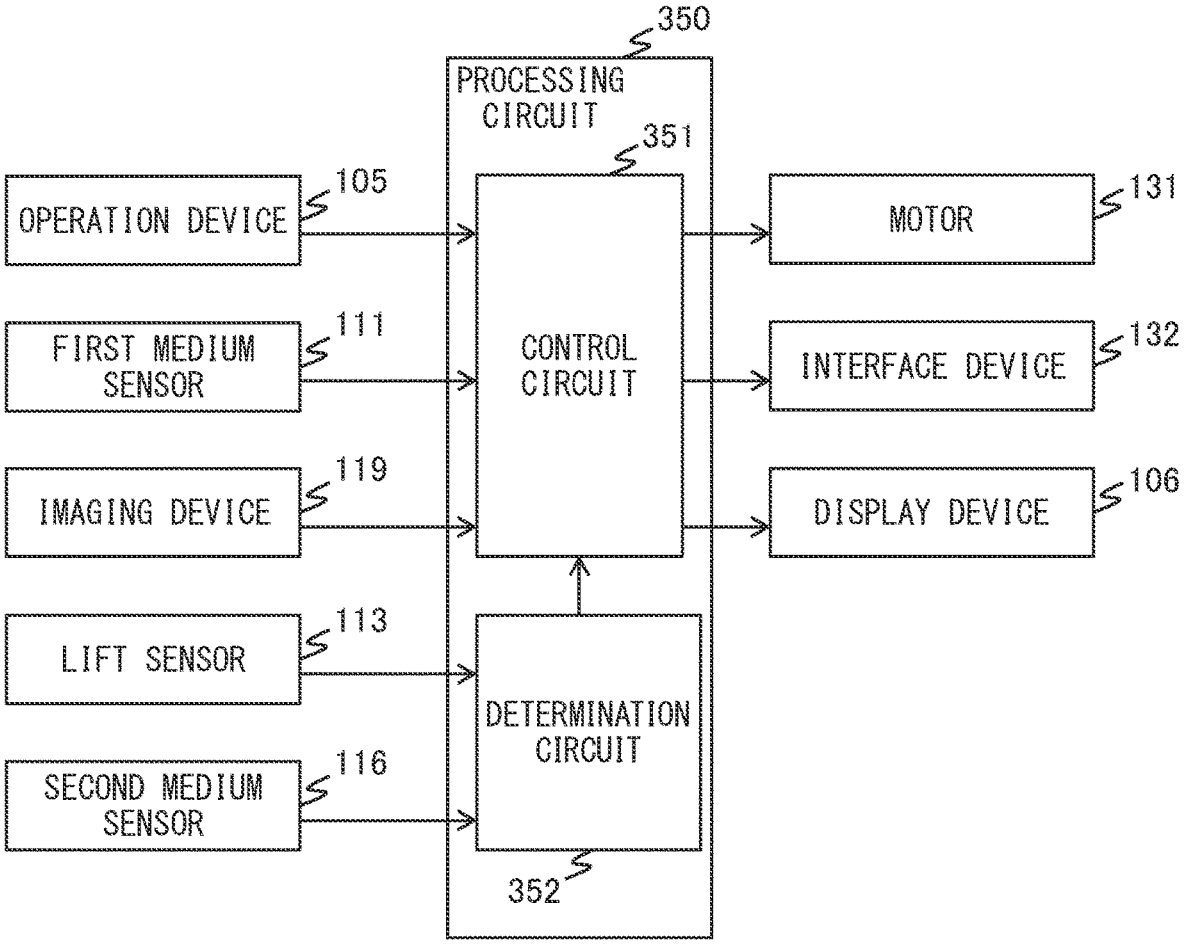
FIG. 16 is a block diagram illustrating an example of a schematic configuration of a processing circuit 350.

FIG. 16 is a diagram illustrating a schematic configuration of a processing circuit 350 in a medium conveying apparatus according to another embodiment. The processing circuit 350 is used in place of the processing circuit 150 in the medium conveying apparatus 100 and executes the medium reading processing. The processing circuit 350 includes a control circuit 351 and a determination circuit 352. Each of these components may be independently configured with an integrated circuit, a microprocessor, firmware, or the like.

The control circuit 351 is an example of a control unit and has a function similar to that of the control unit 151. The control circuit 351 receives an operation signal from an operation device 105, a first medium signal from a first medium sensor 111, and a determination result in the determination processing from the determination circuit 352 and controls a motor 131 on the basis of the received signals and the received determination result. Further, the control circuit 351 receives an input image from an imaging device 119, stores the image into a storage device 140, and transmits the image to an information processing device through an interface device 132.

The determination circuit 352 is an example of a determination unit and has a function similar to that of the determination unit 152. The determination circuit 352 receives a lift detection signal and a second medium signal from a lift sensor 113 and a second medium sensor 116, respectively. The determination circuit 352 determines whether or not a medium is a bound medium, or the like on the basis of the received signals and outputs the determination result to the control circuit 351.

As described above, the medium conveying apparatus can appropriately detect a bound medium when the processing circuit 350 is used as well.

It should be understood by a person skilled in the art that various changes, substitutions, and modifications can be made to the present invention without departing from the spirit and scope of the present invention. For example, the aforementioned embodiments and modified examples thereof may be implemented in combination as appropriate.

According to some embodiments, the medium conveying apparatus, the control method, and the computer-readable, non-transitory medium storing the control program, enables suitable detection of a bound medium.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

The invention claimed is:

1. A medium conveying apparatus comprising:

a loading tray;

a pick roller feeding a medium placed on the loading tray;

a separation roller located on a downstream side of the pick roller in a conveying direction of the medium;

an arm located above a conveyance path of the medium in such a way as to be raised according to a lift of the medium; and a lift sensor detecting the lift of the medium between an upstream side of a roller nip of the pick roller and a downstream side of a roller nip of the separation roller in the conveying direction by detecting a rise of the arm, wherein an upstream-side edge of the arm is located on an upstream side of a downstream edge of the loading tray, and a downstream-side edge of the arm is located on a downstream side of the downstream edge of the loading tray, in the conveying direction.

2. The medium conveying apparatus according to claim 1, wherein the lift sensor detects a lift of the medium outside the pick roller and the separation roller in a direction orthogonal to the conveying direction.

3. The medium conveying apparatus according to claim 2, wherein the lift sensor is located outside the pick roller and the separation roller in a direction orthogonal to the conveying direction.

4. The medium conveying apparatus according to claim 1, wherein the arm is wider in a direction orthogonal to the conveying direction than the pick roller.

5. The medium conveying apparatus according to claim 1, wherein the arm is wider in a direction orthogonal to the conveying direction than the separation roller.

6. The medium conveying apparatus according to claim 1, wherein the arm includes an arm body and an arm tip closer to the lift sensor than the arm body, and the arm body is wider in a direction orthogonal to the conveying direction than the arm tip.

7. The medium conveying apparatus according to claim 1, wherein the lift sensor includes a light-emitting part and a light-receiving part for detecting light from the light-emitting part, the light-receiving part being provided to face the light-emitting part with an arm tip of the arm in between, the arm tip is formed in such a way as to interrupt light from the light-emitting part in an unraised state and pass light from the light-emitting part to the light-receiving part in a raised state, and the lift sensor detects a lift of the medium when the light-receiving part detects light from the light-emitting part.

8. The medium conveying apparatus according to claim 1, further comprising:

an output tray on which the medium conveyed along the conveyance path is ejected, wherein the lift sensor is located between the conveyance path and the output tray.

9. The medium conveying apparatus according to claim 1, further comprising a second lift sensor detecting a lift of the medium.

10. The medium conveying apparatus according to claim 9, wherein the lift sensor detects a lift of the medium at one side outside the pick roller and the separation roller in a direction orthogonal to the conveying direction, and the second lift sensor detects a lift of the medium at the other side of outside the pick roller and the separation roller in a direction orthogonal to the conveying direction.

11. The medium conveying apparatus according to claim 1, further comprising a processor to execute abnormality processing when the lift sensor detects a lift of the medium.

12. The medium conveying apparatus according to claim 11, further comprising a medium detection sensor located on a downstream side of the separation roller in the conveying direction and detecting the medium, wherein the processor executes abnormality processing when the lift sensor detects a lift of the medium in a first predetermined period after the medium detection sensor detected the medium.

13. The medium conveying apparatus according to claim 11, wherein the processor does not execute abnormality processing regardless of whether a lift of the medium is detected in a first predetermined period after the medium sensor detected the medium when a lift of the medium is detected in a second predetermined period from a start of rotation of the pick roller to a time point before the medium is detected by the medium detection sensor.

14. The medium conveying apparatus according to claim 11, wherein the processor does not execute abnormality processing when a lift of the medium is detected a predetermined number of times or greater after a second predetermined period from a start of rotation of the pick roller to a time point before the medium is detected by the medium detection sensor elapsed and before a first predetermined period after the medium sensor detected the medium started.

15. The medium conveying apparatus according to claim 11, wherein the processor does not execute abnormality processing after elapse of a first predetermined period after the medium sensor detected the medium.

16. A medium conveying method comprising:

feeding a medium placed on a loading tray by a pick roller;

detecting, by a lift sensor, a lift of the medium between an upstream side of a roller nip of the pick roller and a downstream side of a roller nip of a separation roller in a conveying direction of a medium by detecting a rise of an arm located above a conveyance path of the medium in such a way as to be raised according to a lift of the medium, wherein the separation roller is located on a downstream side of the pick roller in the conveying direction, and wherein an upstream-side edge of the arm is located on an upstream side of a downstream edge of the loading tray, and a downstream-side edge of the arm is located on a downstream side of the downstream edge of the loading tray, in the conveying direction.

* * * * *